US009587863B2

(12) United States Patent
Kawano et al.

(10) Patent No.: US 9,587,863 B2
(45) Date of Patent: Mar. 7, 2017

(54) REFRIGERATION APPARATUS

(71) Applicant: DAIKIN INDUSTRIES, LTD., Osaka-shi, Osaka (JP)

(72) Inventors: Satoshi Kawano, Sakai (JP); Shinya Matsuoka, Sakai (JP); Masahiro Oka, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 14/404,307

(22) PCT Filed: Apr. 19, 2013

(86) PCT No.: PCT/JP2013/061597
§ 371 (c)(1),
(2) Date: Nov. 26, 2014

(87) PCT Pub. No.: WO2013/179803
PCT Pub. Date: Dec. 5, 2013

(65) Prior Publication Data

US 2015/0143841 A1 May 28, 2015

(30) Foreign Application Priority Data

May 28, 2012 (JP) ..... 2012-121213
Dec. 18, 2012 (JP) ..... 2012-276152

(51) Int. Cl.
*F25B 41/04* (2006.01)
*F25B 13/00* (2006.01)
(Continued)

(52) U.S. Cl.
CPC ..... *F25B 41/04* (2013.01); *F25B 1/005* (2013.01); *F25B 13/00* (2013.01); *F25B 49/02* (2013.01);
(Continued)

(58) Field of Classification Search
CPC ..... F25B 1/005; F25B 2700/1931; F25B 2700/195; F25B 2500/12; F25B 2600/2509;
(Continued)

(56) References Cited

U.S. PATENT DOCUMENTS

2010/0115975 A1* 5/2010 Mitra ..... F25B 1/10 62/196.1
2010/0132399 A1 6/2010 Mitra et al.
2010/0180612 A1 7/2010 Kasahara et al.

FOREIGN PATENT DOCUMENTS

JP 2008-96095 A 4/2008
JP 2009-127902 A 6/2009
(Continued)

OTHER PUBLICATIONS

International Search Report of corresponding PCT Application No. PCT/JP2013/061597 dated Jul. 30, 2013.
(Continued)

*Primary Examiner* — Emmanuel Duke
(74) *Attorney, Agent, or Firm* — Global IP Counselors

(57) ABSTRACT

A refrigeration apparatus uses R32 as refrigerant, and includes a compressor, a condenser, an expansion mechanism, an evaporator, a branch flow channel branching from a main refrigerant channel joining the condenser and the evaporator, a first opening adjustable valve disposed along the branch flow channel, an injection heat exchanger, a first injection channel, a refrigerant storage tank disposed along the main refrigerant channel, and a second injection channel. The injection heat exchanger exchanges heat between refrigerant in the main refrigerant channel and refrigerant passing through the first opening adjustable valve. The first injection channel guides refrigerant that flows in the branch flow channel and that exits from the injection heat exchanger to the compressor or the suction passage. The second injection
(Continued)

channel guides a gas component of refrigerant accumulated inside the refrigerant storage tank to the compressor or the suction passage.

3 Claims, 9 Drawing Sheets

(51) Int. Cl.
*F25B 1/00* (2006.01)
*F25B 49/02* (2006.01)
*F25B 1/10* (2006.01)

(52) U.S. Cl.
CPC ..... *F25B 1/10* (2013.01); *F25B 2313/005* (2013.01); *F25B 2313/006* (2013.01); *F25B 2313/0233* (2013.01); *F25B 2313/0272* (2013.01); *F25B 2313/02741* (2013.01); *F25B 2500/12* (2013.01); *F25B 2600/2509* (2013.01); *F25B 2600/2515* (2013.01); *F25B 2700/195* (2013.01); *F25B 2700/1931* (2013.01)

(58) Field of Classification Search
CPC ..... F25B 2600/2515; F25B 2313/055; F25B 2313/006; F25B 2313/0272; F25B 2313/0233
See application file for complete search history.

(56) References Cited

FOREIGN PATENT DOCUMENTS

| | | | |
|---|---|---|---|
| JP | 2009127902 A | * | 6/2009 |
| JP | 2009-180427 A | | 8/2009 |
| JP | 2009180427 A | * | 8/2009 |

OTHER PUBLICATIONS

International Preliminary Report of corresponding PCT Application No. PCT/JP2013/061597 dated Dec. 2, 2014.
European Search Report of corresponding EP Application No. 13 79 6499.5 dated Apr. 14, 2016.

* cited by examiner

REFRIGERATION APPARATUS

CROSS-REFERENCE TO RELATED APPLICATIONS

This U.S. National stage application claims priority under 35 U.S.C. §119(a) to Japanese Patent Application Nos. 2012-121213, filed in Japan on May 28, 2012, and 2012-276152, filed in Japan on Dec. 18, 2012, the entire contents of which are hereby incorporated herein by reference.

TECHNICAL FIELD

The present invention relates to a refrigeration apparatus, and more specifically, a refrigeration apparatus that uses R32 as a refrigerant.

BACKGROUND ART

In the conventional art, among refrigeration apparatuses such as air conditioning apparatuses and like, are apparatuses that use R32 as the refrigerant. When using R32 as the refrigerant, the discharge temperature of the compression mechanism tends to be higher in comparison to the case of using R410A or R22 as the refrigerant. Recognizing this problem, an air conditioning apparatus that lowers the refrigerant discharge temperature while using R32 is described in Japanese Laid-open Patent Application No. 2009-127902. In this air conditioning apparatus, part of the liquid refrigerant exiting from a gas liquid separator disposed in a high-pressure line is caused to bypass to a compression mechanism, that bypassed refrigerant then being converted to a flash gas state in an internal heat exchanger. That refrigerant, bypassed to the compression mechanism and converted into a flash gas is injected, lowering the enthalpy of refrigerant in an intermediate-pressure state in the compressor, causing a decrease in the discharge temperature of refrigerant in the compression mechanism.

SUMMARY

Technical Problem

If the refrigerant from the high-pressure main refrigerant channel is caused to bypass and is depressurized, and then that refrigerant is evaporated in an internal heat exchanger and supplied to a compressor, it is certainly possible to lower the discharge temperature of the compressor.

However, in the case in which the outdoor unit of an air conditioning apparatus is positioned higher in comparison to the indoor unit, the pressure of refrigerant coming out of the gas liquid separator of the outdoor unit during the heating operation may become very low. Further, in the case in which the refrigerant communication tubes joining the outdoor unit and the indoor unit are long, it is conceivable that the pressure of refrigerant coming out of the gas liquid separator will decrease. When the pressure of such refrigerant that is caused to bypass is low, the room for depressurizing the refrigerant that is caused to bypass prior to entry into the internal heat exchanger decreases and the temperature difference between the refrigerant that is caused to bypass and the refrigerant flowing in the main refrigerant channel in the internal heat exchanger becomes small, causing concern that the quantity of flash gas or the dryness may not be maintained. In order to prevent these problems it becomes necessary to increase the size of the internal heat exchanger, which then raises production costs and makes it necessary to increase the size of the outdoor unit.

An object of the present invention is to provide a refrigeration apparatus having a heat exchanger that exchanges heat between refrigerant flowing in the main refrigerant channel and refrigerant diverged from the main refrigerant channel, in which the refrigerant diverged from the main refrigerant channel is supplied to a compressor or a suction pipe, lowering the discharge temperature of the compressor, while minimizing increase in the size of the heat exchanger and maintaining the function of reducing the discharge temperature of the compressor.

Solution to the Problem

A refrigeration apparatus according to a first aspect of the present invention uses R32 as the refrigerant, and is provided with a compressor, a condenser, an expansion mechanism, an evaporator, a branch flow channel, a first opening adjustable valve, a heat exchanger for injection, a first injection channel, a refrigerant storage tank, and a second injection channel. The compressor sucks in low-pressure refrigerant from a suction passage, compresses the refrigerant and discharges high-pressure refrigerant. The condenser condenses high-pressure refrigerant discharged from the compressor. The expansion mechanism expands the high-pressure refrigerant that comes out of the condenser. The evaporator evaporates the refrigerant expanded by the expansion mechanism. The branch flow channel is a channel that branches from the main refrigerant channel joining the condenser and the evaporator. The first opening adjustable valve is disposed in the branch flow channel, and the degree of opening can be adjusted. The heat exchanger for injection exchanges heat between the refrigerant that flows in the main refrigerant channel and refrigerant that passes through the first opening adjustable valve of the branch flow channel. The first injection channel guides refrigerant that flows in the branch flow channel and exits from the heat exchanger for injection, to the compressor or the suction passage. The refrigerant storage tank is disposed along the main refrigerant channel. The second injection channel guides the gas component of refrigerant accumulated inside the refrigerant storage tank to the compressor or the suction passage.

This refrigeration apparatus according to the present invention, furnished with the heat exchanger for injection and the first injection channel, depressurizes refrigerant branched from the main refrigerant channel connecting the condenser and the evaporator at the first opening adjustable valve of the branch flow channel, and heats the refrigerant in the heat exchanger for injection. The depressurized, heated refrigerant, that has become flash gas in a gas-liquid two-phase state, saturated gas or superheated gas, is flowed to the compressor or the suction passage by passing through the first injection channel, enabling the discharge temperature of the compressor to be lowered. On the other hand, as the refrigeration apparatus is further furnished with the refrigerant storage tank and the second injection channel, the gas component (saturated gas) of refrigerant accumulated inside the refrigerant storage tank, is flowed to the compressor or the suction passage via the second injection channel, which also enables the discharge temperature of the compressor to be lowered. Thus, as there are two injection routes, in the refrigeration apparatus according to the present invention, even in the case in which the pressure of the refrigerant diverged from the main refrigerant channel is low, and the dryness and quantity of refrigerant flowing to the compressor is unable to be maintained even after being heated at the heat exchanger for injection, it is possible to lower the discharge temperature of the compressor using the refrigerant from the refrigerant storage tank. Further, as it is possible to use either of the two routes, it becomes unnecessary to increase the size of the heat exchanger for injection in order to maintain the dryness of refrigerant flowing to the compressor, regardless of the refrigerant state, thereby minimizing an increase in the size of the heat exchanger, and enabling the function of reducing the discharge temperature of the compressor to be maintained.

A refrigeration apparatus according to a second aspect of the present invention is the refrigeration apparatus according to the first aspect of the present invention further provided with a control unit. The control unit switches between a first injection control that flows refrigerant to primarily the first injection channel, and a second injection control that flows refrigerant to primarily the second injection channel.

Here, when the first injection control is performed, refrigerant diverged from the main refrigerant channel joining the condenser and the evaporator, is depressurized by the first opening adjustable valve of the branch flow channel, and heated in the heat exchanger for injection. Then, the depressurized, heated refrigerant that is a gas-liquid two-phase flash gas, saturated gas or superheated gas, passes through the first injection channel, flowing to the compressor or the suction passage, serving to lower the discharge temperature of the compressor. On the other hand, when the second injection control is performed, the gas component (saturated gas) of refrigerant accumulated in the refrigerant storage tank passes through the second injection channel and flows to the compressor or the suction passage, serving to lower the discharge temperature of the compressor. In this way, this refrigeration apparatus according to the present invention is configured to enable switching between the first injection control that flows refrigerant to primarily the first injection channel and the second injection control that flows refrigerant to primarily the second injection channel. Accordingly, even in the case in which the pressure of the refrigerant diverged from the main refrigerant channel is low, and the dryness and quantity of refrigerant flowing to the compressor is unable to be maintained even after being heated at the heat exchanger for injection, it is possible to switch to the second injection control and lower the discharge temperature of the compressor. Further, as it is possible to use the second injection control as well as the first injection control, regardless of the state of the refrigerant, it becomes unnecessary to increase the size of the heat exchanger for injection in order to maintain the dryness of refrigerant flowing to the compressor, thereby minimizing an increase in the size of the heat exchanger, while enabling the function of reducing the discharge temperature of the compressor to be maintained.

The first injection control is control for lowering the discharge temperature of the compressor through refrigerant flowing in primarily the first injection channel. The first injection control operates such that almost no refrigerant flows in the second injection channel or the quantity of refrigerant that flows in the second injection channel is less than the quantity of refrigerant that flows in the first injection channel. The second injection control is control for lowering the discharge temperature of the compressor with refrigerant flowing in primarily the second injection channel. The second injection control operates such that almost no refrigerant flows in the first injection channel or the quantity of refrigerant that flows in the first injection channel is less than the quantity of refrigerant that flows in the second injection channel.

A refrigeration apparatus according to a third aspect of the present invention is the refrigeration apparatus according to the second aspect of the present invention, in which the control unit switches between the first injection control and the second injection control based on the pressure of refrigerant in the main refrigerant channel between the condenser and the expansion mechanism.

Here, in the case in which the pressure is low in the refrigerant flowing via the first opening adjustable valve and the heat exchanger for injection to the compressor or the suction passage, given that it is not possible to maintain the quantity and dryness of refrigerant exiting from the heat exchanger for injection, the switching between the first injection control and the second injection control is performed based on the pressure of refrigerant in the main refrigerant channel that is diverged by the branch flow channel (basically, the pressure of refrigerant between the condenser and the expansion mechanism). Accordingly, even in the case in which injection using the first injection channel largely cannot be performed, the discharge temperature of the compressor can be lowered.

Note that the pressure of refrigerant in the main refrigerant channel between the condenser and the expansion mechanism can be directly detected by for example, installing a pressure gauge. Further, by obtaining the quantity of circulating refrigerant from the compressor frequency, the pressure of low-pressure refrigerant in the suction passage or the pressure of high-pressure refrigerant discharged from the compressor, and calculating the amount of depressurization in the expansion mechanism of the main refrigerant channel, it is possible to calculate the pressure of refrigerant in the main refrigerant channel from the amount of depressurization of the expansion mechanism and the difference between the high and low pressures. For the pressure of high-pressure refrigerant or of low-pressure refrigerant, it is suitable to detect these using a pressure gauge, and it is also suitable to calculate from the refrigerant saturation temperature or the like.

Moreover, the switching between the first injection control and the second injection control performed based on the pressure of refrigerant in the main refrigerant channel diverged by the branch flow channel, includes switching performed based on a detected value or estimated value of the pressure of refrigerant in the main refrigerant channel between the condenser and the expansion mechanism, and also includes switching performed based on a detected value related to the pressure of refrigerant in the main refrigerant channel between the condenser and the expansion mechanism.

A refrigeration apparatus according to a fourth aspect of the present invention is the refrigeration apparatus according to either the second aspect or the third aspect of the present invention further provided with a second opening adjustable valve. The second opening adjustable valve is disposed along the second injection channel and the degree of opening can be adjusted. The first injection channel and the second injection channel cause the refrigerant to merge with intermediate-pressure refrigerant of the compressor. The control unit, in the first injection control, causes refrigerant from primarily the first injection channel to merge with intermediate-pressure refrigerant of the compressor, and in the second injection control, causes refrigerant from primarily the second injection channel to merge with intermediate-pressure refrigerant of the compressor.

Here, as the refrigerant flowing in each of the injection channels is caused to merge with intermediate-pressure refrigerant of the compressor, it is possible to suppress the rotational speed of the compressor while maintaining capacity, thereby improving the efficiency of the refrigeration apparatus. Further, during the first injection control the first opening adjustable valve is adjusted, and during the second injection control the second opening adjustable valve is adjusted, such that the discharge temperature of the compressor can be lowered through performing the appropriate injection.

A refrigeration apparatus according to a fifth aspect of the present invention is the refrigeration apparatus according to the second aspect of the present invention, in which the control unit switches between the first injection control, the second injection control and a third injection control, the third injection control being a control that flows refrigerant to both the first injection channel and the second injection channel.

Here, in addition to the first injection control that flows refrigerant to primarily the first injection channel and the second injection control that flows refrigerant to primarily the second injection channel, the third injection control is provided. The control unit, through the third injection control, flows refrigerant to the first injection channel and the second injection channel. That is, the third injection control flows refrigerant from the heat exchanger for injection via the first injection channel to the compressor or the suction passage, and also flows refrigerant from the refrigerant storage tank via the second injection channel to the compressor or the suction passage. In this way, as the first, second and third injection controls are provided, the appropriate injection control is selected based on the operating condition and installation conditions of the refrigeration apparatus, leading to improved operating capacity and a reduction in the discharge temperature of the compressor.

A refrigeration apparatus according to a sixth aspect of the present invention is the refrigeration apparatus according to the fifth aspect of the present invention, in which the control part, in the third injection control, changes the ratio between the quantity of refrigerant flowed to the first injection channel and the quantity of refrigerant flowed to the second injection channel, based on the pressure of refrigerant in the main refrigerant channel between the condenser and the expansion mechanism.

If the pressure of refrigerant in the main refrigerant channel between the condenser and the expansion mechanism decreases, depending on the size of the heat exchanger for injection, the dryness and quantity of refrigerant flowing from the heat exchanger for injection to the first injection channel may not reach the desired levels. Further, if the pressure of refrigerant in the main refrigerant channel decreases, in the case in which there is substantial difference between the height of the position of the condenser and the height of the position of the evaporator, such that there is substantial difference between the elevation of the condenser and the evaporator, it is not preferable to control accumulation (control that further decreases the pressure) of the gas component of the refrigerant in the refrigerant storage tank.

However, in the third injection control of the refrigeration apparatus according to the sixth aspect of the present invention that flows refrigerant from the heat exchanger for injection and the refrigerant storage tank simultaneously to the compressor and the like, the ratio of the quantity of refrigerant subject to injection that flows from the heat exchanger for injection to the first injection channel and the quantity of refrigerant subject to injection that flows from the refrigerant storage tank to the second injection channel, is changed based on the pressure of refrigerant in the main refrigerant channel. Control implemented in this way enables injection to be implemented as appropriate and prevents adverse effects occurring at other places in the refrigeration apparatus due to injection of refrigerant.

A refrigeration apparatus according to a seventh aspect of the present invention is the refrigeration apparatus according to the second aspect of the present invention, in which the control unit switches between the first injection control, the second injection control, and non-injection control. The non-injection control is control such that refrigerant does not flow in the first injection channel or the second injection channel.

Here, as the discharge temperature is low, it is not necessary to decrease the temperature of the compressor through suction injection or intermediate injection, moreover, in the case for example in which the rotational speed of the compressor is low as low capacity is required, the control unit can switch to non-injection control. If the switch to non-injection control is made, increase of capacity through suction injection or intermediate injection and the occurrence of substantially decreased operating efficiency are minimized, enabling operating efficiency to be maintained while fulfilling the requirement of low capacity.

Advantageous Effects of Invention

The refrigeration apparatus according to the first aspect of the present invention uses refrigerant from the refrigerant storage tank, thereby enabling the discharge temperature of the compressor to be reduced, even in the case in which the pressure of refrigerant diverged from the main refrigerant line is low and though heated by the heat exchanger for injection, the dryness and quantity of the refrigerant flowed to the compressor cannot be maintained.

The refrigeration apparatus according to the second aspect of the present invention switches to the second injection control thereby enabling the discharge temperature of the compressor to be reduced, even in the case in which the pressure of refrigerant diverged from the main refrigerant line is low and though heated by the heat exchanger for injection, the dryness and quantity of the refrigerant flowed to the compressor cannot be maintained.

The refrigeration apparatus according to the third aspect of the present invention switches to the second injection control, such that appropriate operation to reduce the discharge temperature of the compressor is performed even in the case in which due to the refrigerant pressure injection using the first injection channel is largely unable to be performed.

The refrigeration apparatus according to the fourth aspect of the present invention merges the refrigerant from the injection channel with intermediate-pressure refrigerant of the compressor, thereby improving the efficiency of the refrigeration apparatus, and enabling the appropriate injection to be performed by adjusting the degree of opening of each opening adjustable valve.

The refrigeration apparatus according to the fifth aspect of the present invention selects the appropriate injection control based on the operating condition and installation conditions of the refrigeration apparatus, leading to improved operating capacity and a reduction in the discharge temperature of the compressor.

The refrigeration apparatus according to the sixth aspect of the present invention enables injection to be performed as appropriate and suppresses adverse effects occurring at other places in the refrigeration apparatus due to injection of refrigerant.

In the refrigeration apparatus according to the seventh aspect of the present invention, increase of capacity through suction injection or intermediate injection and the occurrence of decreased operating efficiency are minimized, enabling operating efficiency to be maintained while fulfilling the requirement of low capacity.

DESCRIPTION OF EMBODIMENTS

Figure 1:
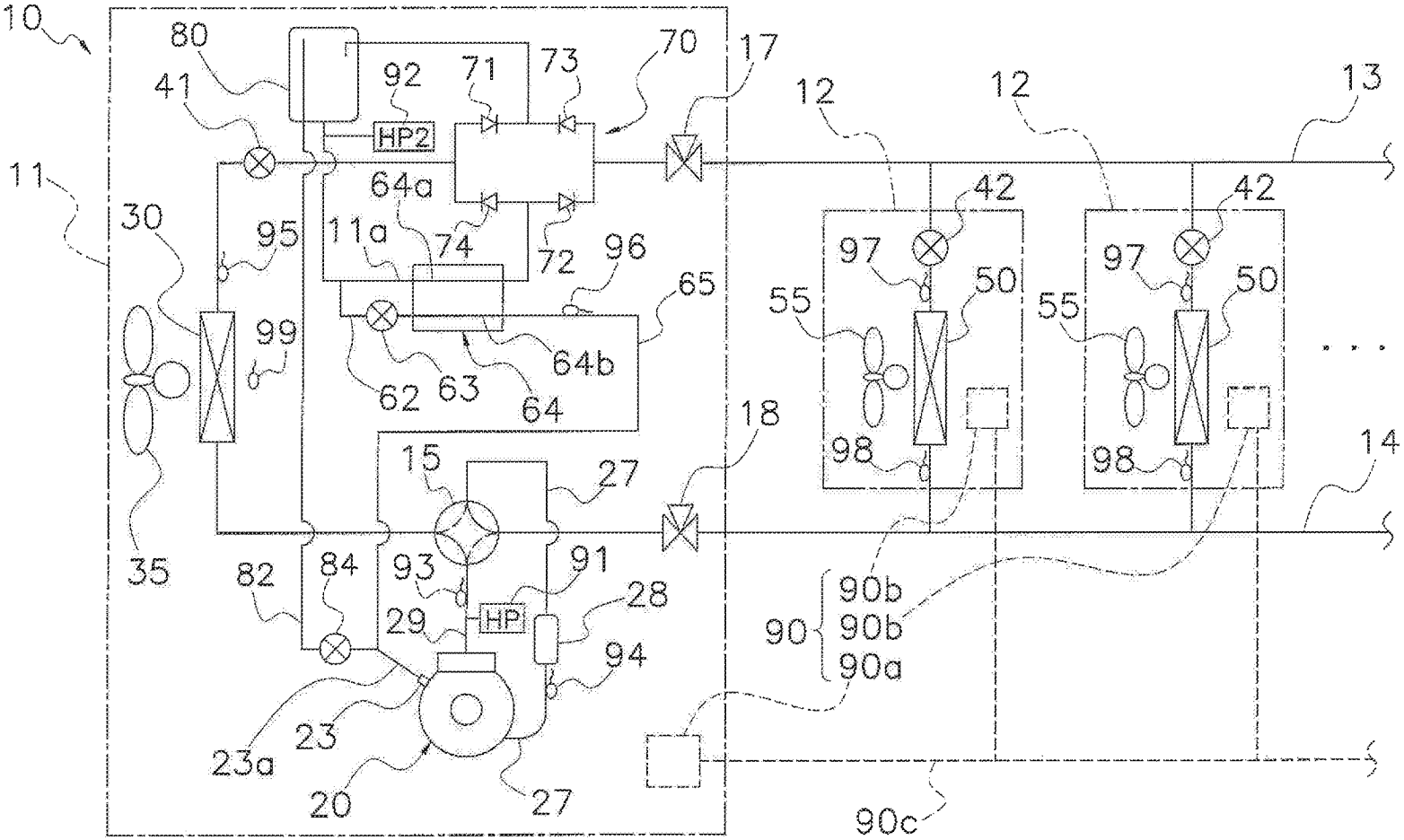
FIG. 1 shows the refrigerant piping system of an air conditioning apparatus according to the first embodiment of the present invention.

First Embodiment (1) FIG. 1 shows the refrigerant piping system of an air conditioning apparatus 10, being a refrigeration apparatus according to the first embodiment of the present invention. The air conditioning apparatus 10 is a distributed refrigerant piping system air conditioning apparatus, that cools and heats each room inside a building by vapor compression type refrigerant cycle operation. The air conditioning apparatus 10 is provided with an outdoor unit 11 as a heat source unit, a plurality of indoor units 12 as usage-side units, and a liquid refrigerant communication pipe 13 and gas refrigerant communication pipe 14 as refrigerant communication pipes that connect the outdoor unit 11 to the indoor units 12. That is, the refrigerant circuit of the air conditioning apparatus 10 shown in FIG. 1, is configured such that the outdoor unit 11, the indoor units 12, the liquid refrigerant communication pipe 13 and the gas refrigerant communication pipe 14 are connected. The liquid refrigerant communication pipe 13 and the gas refrigerant communication pipe 14 are, in the case of a long piping configuration, 150 m long or longer. The total length of the piping of the liquid refrigerant communication pipe 13 and the gas refrigerant communication pipe 14 in order to connect the plurality of indoor units 12 with the single outdoor unit 11 can be up to 1000 m. Further, although it is envisaged that there may be a difference in the elevations in which the outdoor unit 11 and the indoor units 12 are installed, in the case that the outdoor unit 11 is installed in a low place and the indoor units 12 are installed in a higher place, the difference in elevation between the highest positioned indoor unit 12 and the outdoor unit 11 can be up to 40 m. On the other hand, in the case in which the outdoor unit 11 is installed in a high place such as on a roof or the like, and the indoor units 12 are installed in a low place, the difference in elevation between the lowest positioned indoor unit 12 and the outdoor unit 11 can be up to 90 m.

Refrigerant is sealed in the refrigerant circuit shown in FIG. 1, and as described subsequently, is subjected in that circuit to the operations of a refrigerant cycle in which the refrigerant is compressed, cooled and condensed, depressurized, then heated and evaporated, after which the refrigerant is compressed again. R32 is used as the refrigerant. R32 is a low GWP refrigerant with a low warming coefficient, a type of HFC refrigerant. Further, an ether-based synthetic oil having some degree of compatibility with R32 is used as the refrigerator oil.

(2) Detailed Configuration of the Air Conditioning Apparatus (2-1) Indoor Units

The indoor units 12 are installed on the ceiling or a side wall in each room and are connected to the outdoor unit 11 via the refrigerant communication pipes 13 and 14. The indoor unit 12 has primarily, an indoor expansion valve 42 that is a pressure reducer and an indoor heat exchanger 50 as a usage-side heat exchanger.

The indoor expansion valve 42 is an expansion mechanism that depressurizes the refrigerant, being an electric valve having an adjustable opening. One end of the indoor expansion valve 42 is connected to the liquid refrigerant communication pipe 13 and the other end is connected to the indoor heat exchanger 50.

The indoor heat exchanger 50 is a heat exchanger that functions as an evaporator or a condenser of refrigerant. One end of the indoor heat exchanger 50 is connected to the indoor expansion valve 42 and the other end is connected to the gas refrigerant communication pipe 14.

The indoor unit 12 has an indoor fan 55 for sucking in indoor air and resupplying the air indoors, facilitating exchange of heat between the indoor air and the refrigerant flowing in the indoor heat exchanger 50.

Further, the indoor unit 12 has an indoor controller **90*b* for controlling the operation of each part that configures the indoor unit 12 and each kind of sensor. The indoor controller 90*b* has a microcomputer or memory or the like installed for controlling the indoor unit 12, exchanges control signals or the like with a remote control unit (not shown in the drawing) to facilitate individual operation of the indoor unit 12, and exchanges control signals or the like via a transmission line 90*c* with an outdoor controller 90*a* of the outdoor unit 11, described subsequently. The various sensors include an indoor liquid pipe temperature sensor 97 and an indoor gas pipe temperature sensor 98 that are installed in the indoor unit 12. The indoor liquid pipe temperature sensor 97 is attached to a refrigerant pipe that connects the indoor expansion valve 42 and the indoor heat exchanger 50. The indoor gas pipe temperature sensor 98 is attached to a refrigerant pipe extending from the indoor heat exchanger 50 to the gas refrigerant communication pipe 14**.

(2-2) Outdoor Unit

The outdoor unit 11 is installed either outside or in the basement of the building having each room in which the indoor unit 12 is deployed, and is connected to the indoor units 12 via the refrigerant communication pipes 13 and 14. Primarily, the outdoor unit 11 has a compressor 20, a four-way switching valve 15, an outdoor heat exchanger 30, an outdoor expansion valve 41, a bridge circuit 70, a high-pressure receiver 80, a first electric injection valve 63, a heat exchanger for injection 64, a second electric injection valve 84, a liquid-side shut off valve 17 and a gas-side shut off valve 18.

The compressor 20 is a hermetically sealed compressor driven by a compressor motor. In this embodiment there is one compressor 20, however this embodiment is not limited to this number, and it is suitable to have two or more compressors 20 connected in parallel, depending on the number of connected indoor unit 12. The compressor 20 sucks the gas refrigerant from a suction passage 27 via a vessel 28 appurtenant to the compressor 20. A discharge pressure sensor 91 for detecting the pressure of discharged refrigerant, and a discharge temperature sensor 93 for detecting the temperature of discharged refrigerant are mounted to a discharge-side refrigerant pipe 29 of the compressor 20. Further, an intake temperature sensor 94 for detecting the temperature of the refrigerant sucked into the compressor 20 is mounted to the suction passage 27. Note that the compressor 20 has an intermediate injection port 23 described subsequently.

The four-way switching valve 15 is a mechanism for switching the direction of refrigerant flow. The four-way switching valve 15 connects the discharge-side refrigerant pipe 29 of the compressor 20 and one end of the outdoor heat exchanger 30, and connects the suction passage 27 of the compressor 20 (including the vessel 28) to the gas-side shut off valve 18 (refer the solid line of the four-way switching valve 15 in FIG. 1), such that during the cooling operation, the outdoor heat exchanger 30 is caused to function as a condenser of refrigerant compressed by the compressor 20 and the indoor heat exchanger 50 is caused to function as an evaporator of refrigerant cooled in the outdoor heat exchanger 30. Further, the four-way switching valve 15 connects the discharge-side refrigerant pipe 29 of the compressor 20 and the gas-side shut off valve 18, and connects the suction passage 27 to one end of the outdoor heat exchanger 30 (refer the dashed line of the four-way switching valve 15 in FIG. 1), such that during the heating operation, the indoor heat exchanger 50 is caused to function as a condenser of refrigerant compressed by the compressor 20 and the outdoor heat exchanger 30 is caused to function as an evaporator of refrigerant cooled in the indoor heat exchanger 50. In this embodiment, the four-way switching valve 15 is a four-way valve connected to the suction passage 27, the discharge-side refrigerant pipe 29 of the compressor 20, the outdoor heat exchanger 30 and the gas-side shut off valve 18.

The outdoor heat exchanger 30 is a heat exchanger that functions as an evaporator or a condenser of the refrigerant. One end of the outdoor heat exchanger 30 is connected to the four-way switching valve 15 and the other end is connected to the outdoor expansion valve 41. An outdoor liquid pipe temperature sensor 95 is mounted to the refrigerant pipe connecting the outdoor heat exchanger 30 and the outdoor expansion valve 41, in order to detect the temperature of the refrigerant flowing in that pipe.

The outdoor unit 11 has an outdoor fan 35 that sucks in outdoor air into the unit and expels the air again outdoors. The outdoor fan 35 facilitates exchange of heat between outdoor air and the refrigerant flowing in the outdoor heat exchanger 30, and is driven by an outdoor fan motor. Note that the heat source of the outdoor heat exchanger 30 is not limited to outside air and it is suitable to use a different heating medium such as water or the like.

The outdoor expansion valve 41 is an expansion mechanism for depressurizing the refrigerant, and is an electric valve having an adjustable opening. One end of the outdoor expansion valve 41 is connected to the outdoor heat exchanger 30 and the other end is connected to the bridge circuit 70.

The bridge circuit 70 has four check valves, 71, 72, 73 and 74. The inlet check valve 71 allows the refrigerant from the outdoor heat exchanger 30 to flow only toward the high-pressure receiver 80. The outlet check valve 72 allows the refrigerant from the high-pressure receiver 80 to flow only toward the indoor heat exchanger 50. The inlet check valve 73 allows the refrigerant from the indoor heat exchanger 50 to flow only toward the high-pressure receiver 80. The outlet check valve 74 allows the refrigerant from the high-pressure receiver 80 to flow only toward the indoor heat exchanger 30 via the outdoor expansion valve 41. That is, the inlet check valves 71 and 73 fulfill the function of flowing refrigerant from one of the outdoor heat exchanger 30 and the indoor heat exchanger 50 to the high-pressure receiver 80, while the outlet check valves 72 and 74 fulfill the function of flowing refrigerant from the high-pressure receiver 80 to the other of the outdoor heat exchanger 30 and the indoor heat exchanger 50.

The high-pressure receiver 80 is a container disposed between the outdoor expansion valve 41 and the liquid-side shut off valve 17 that functions as a refrigerant storage tank. During the cooling operation and during the heating operation, the high-pressure receiver 80, into which high-pressure refrigerant has flowed, is not subject to the occurrence of the adverse phenomena in which excess refrigerant, including refrigerator oil, separates into two layers, with the refrigerator oil accumulating in the upper portion, because the surplus refrigerant that accumulates in the high-pressure receiver 80 is kept at a relatively high temperature.

Further, normally liquid refrigerant resides in the lower part of the internal space of the high-pressure receiver 80 and gas refrigerant resides in the upper part. A second injection channel 82 extends from the upper part of that internal space toward the compressor 20. The second injection channel 82 fulfills the function of guiding the gas component of refrigerant accumulated inside the high-pressure receiver 80 to the compressor 20. An adjustable opening second electric injection valve 84 is provided in the second injection channel 82.

A heat exchanger for injection 64 is provided between the outlet of the high-pressure receiver 80 and the outlet check valves 72 and 74 of the bridge circuit 70. A branch flow pipe 62 branches from a part of the main refrigerant channel 11*a* connecting the outlet of the high-pressure receiver 80 and the heat exchanger for injection 64. The main refrigerant channel 11*a* is the main channel for liquid refrigerant, and connects the outdoor heat exchanger 30 and the indoor heat exchanger 50. The high-pressure receiver 80 is disposed between the outdoor expansion valve 41 and the liquid-side shut off valve 17 along the main refrigerant channel 11*a*.

A first electric injection valve 63 having an adjustable opening, is disposed in the branch flow pipe 62. The branch flow pipe 62 is connected to a second flow path 64*b* of the heat exchanger for injection 64. That is, when the first electric injection valve 63 is open, the refrigerant diverged from the main refrigerant channel 11*a* to the branch flow pipe 62 is depressurized at the first electric injection valve 63 and flows to the second channel 64*b* of the heat exchanger for injection 64.

The refrigerant depressurized at the first electric injection valve 63 and flowed to the second channel 64*b* of the heat exchanger for injection 64, is subject to heat exchange with refrigerant flowing in a first channel 64*a* of the heat exchanger for injection 64. The first channel 64*a* of the heat exchanger for injection 64 configures a part of the main refrigerant channel 11*a*. The refrigerant that has flowed through the branch flow pipe 62 and the second channel 64*b* after heat exchange at the heat exchanger for injection 64, is delivered toward the compressor 20 by means of a first injection channel 65. A first injection temperature sensor 96 for detecting the temperature of the refrigerant that has been subject to heat exchange after passing through the second channel 64*b* of the heat exchanger for injection 64, is mounted to the first injection channel 65.

The heat exchanger for injection 64 is an internal heat exchanger employing a double tube structure that performs heat exchange between the refrigerant flowing in the main refrigerant channel 11*a* that is the main path, and the refrigerant diverged from the main refrigerant channel 11*a* for injection, as described above. One end of the first channel 64*a* of the heat exchanger for injection 64 is connected to the outlet of the high-pressure receiver 80, while the other end connects to the outlet check valves 72 and 74 of the bridge circuit 70.

The liquid-side shut off valve 17 is a valve connected to the liquid refrigerant communication pipe 13 that functions to exchange refrigerant between the outdoor unit 11 and the indoor unit 12. The gas-side shut off valve 18 is a valve connected to the gas refrigerant communication pipe 14 that functions to exchange refrigerant between the outdoor unit 11 and the indoor unit 12, the gas-side shut off valve 18 being connected to the four-way switching valve 15. Here, the liquid-side shut off valve 17 and the gas-side shut off valve 18 are three-way valves provided with service ports.

The vessel 28 is arranged in the suction passage 27 between the four-way switching valve 15 and the compressor 20, and fulfills the function of preventing liquid refrigerant from being sucked into the compressor 20 when refrigerant that includes excessive liquid component flows in. Here, while the vessel 28 is provided, it is also suitable to additionally deploy in the suction passage 27, an accumulator for preventing liquid flow back to the compressor 20.

As described above, the intermediate injection port 23 is provided in the compressor 20. The intermediate injection port 23 is a port that introduces refrigerant in order to flow refrigerant from outside into the intermediate-pressure refrigerant in the course of compression in the compressor 20. The above described first injection channel 65 and second injection channel 82 are connected to an intermediate injection pipe 23*a* that is connected to the intermediate injection port 23. When the first electric injection valve 63 is open, intermediate injection is performed that flows refrigerant to the intermediate injection port 23 from the first injection channel 65, and when the second electric injection valve 84 is open, intermediate injection is performed that flows refrigerant to the intermediate injection port 23 from the second injection channel 82. Note that it is possible to replace the compressor 20 with two compressors connected in series and connect the intermediate injection pipe 23*a* to the refrigerant piping connecting the discharge port of a low stage compressor and the suction port of a high-stage compressor.

Figure 3:
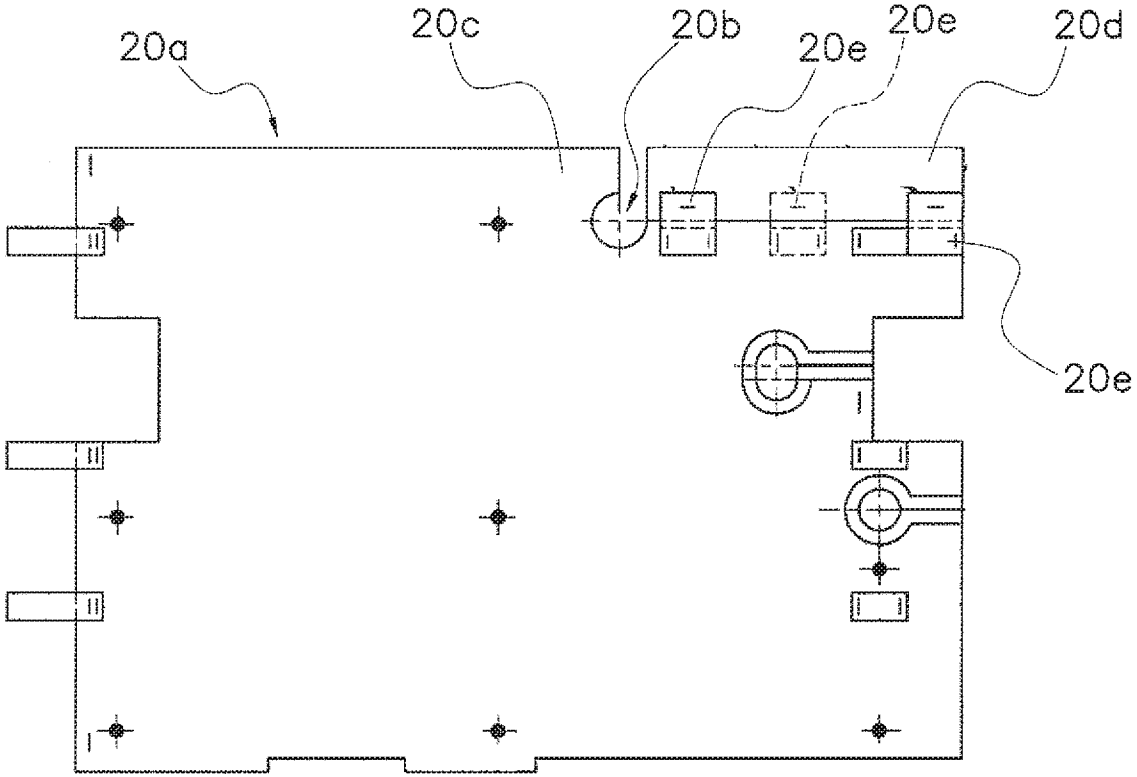
FIG. 3 is a plan view of the soundproof material wound around the compressor.

As shown in FIG. 3, soundproof material 20*a* is wound around the compressor 20. A notch 20*b* that prevents contact with the intermediate injection pipe 23*a* is formed in the soundproof material 20*a*. The soundproof material 20*a* is divided into two parts in consideration of the difficulties that would be incurred in attaching and removing the soundproof material 20*a* if the whole of the soundproof material 20*a* around the notch 20*b* were a single integrated body, when another member such as a casing member of the outdoor unit 11 or the like is provided around the intermediate injection pipe 23*a*. Specifically, the soundproof material 20*a* is divided into a main body section 20*c* and a small piece section 20*d*. The small piece section 20*d* attaches to the main body section 20*c* via a plurality of hook and loop fasteners 20*e*. When the soundproof material 20*a* is removed from the compressor 20 for a reason such as performing maintenance or the like, firstly the small piece section 20*d* is detached from the main body section 20*c*, then the main body section 20*c* is slid to the left side in FIG. 3, removing the soundproof material 20*a* from the intermediate injection pipe 23*a* and the compressor 20.

Further, the outdoor unit 11 has various sensors, and an outdoor controller 90*a*. The outdoor controller 90*a* is provided with memory or a microcomputer or the like, for performing control of the outdoor unit 11, and exchanges control signals and the like via a transmission line 8*a* with the indoor controller 90*b* of the indoor unit 12. The various sensors include the discharge pressure sensor 91, the discharge temperature sensor 93, the intake temperature sensor 94, the outdoor liquid pipe temperature sensor 95 and the first injection temperature sensor 96 described above, a receiver outlet pressure sensor 92, and an outdoor air temperature sensor 99 for detecting the outside air temperature. The receiver outlet pressure sensor 92, mounted to a part of the main refrigerant channel 11*a* between the outlet of the high-pressure receiver 80 and the heat exchanger for injection 64, is a sensor for detecting the pressure of refrigerant exiting the high-pressure receiver 80.

(2-3) Refrigerant Communication Pipes

The refrigerant communication pipes 13 and 14 are refrigerant pipes that are installed on site when the outdoor unit 11 and the indoor units 12 are installed on location.

(2-4) Controller

Figure 2:
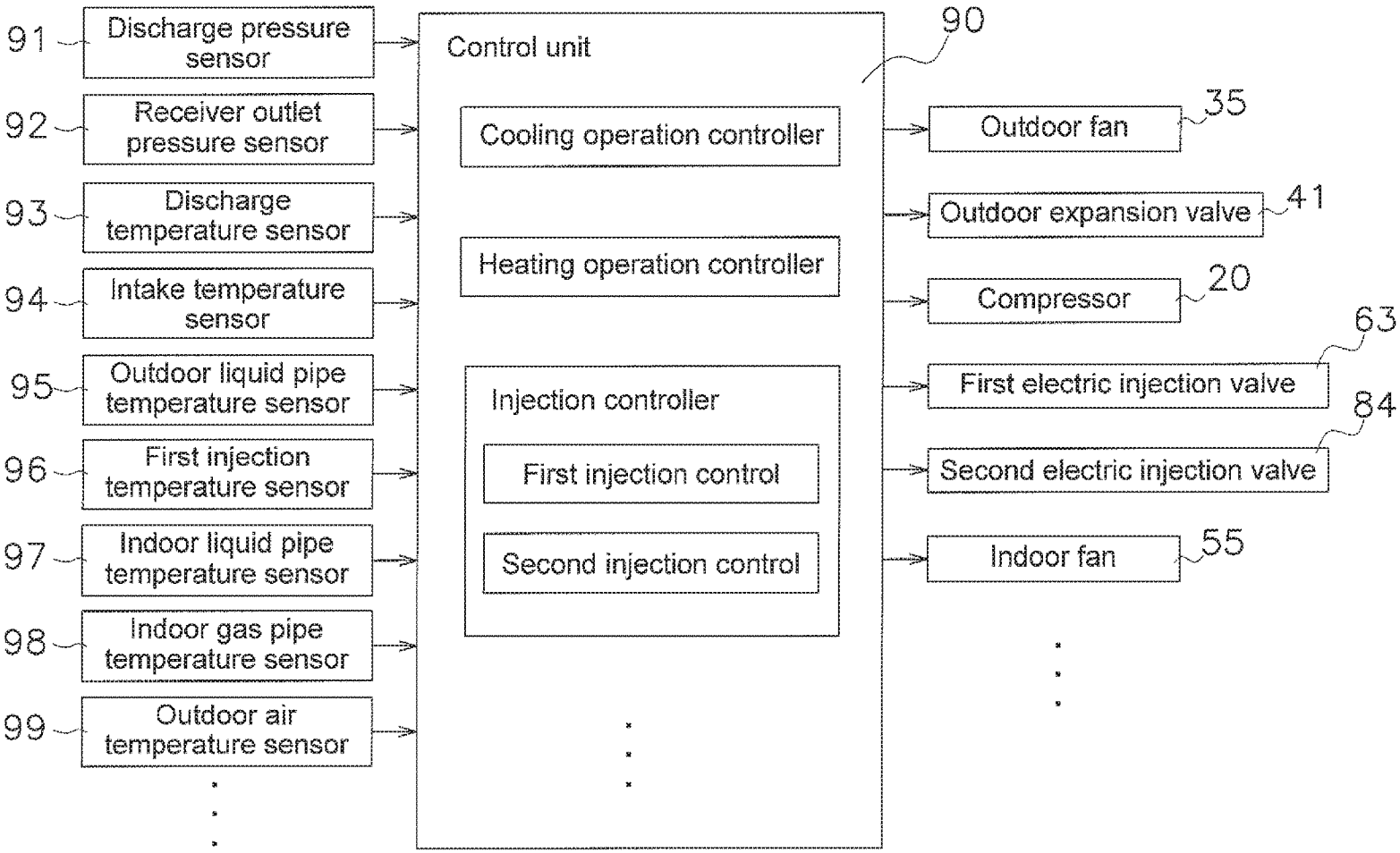
FIG. 2 is a control block diagram of the control unit of the air conditioning apparatus.

The controller 90, control device for performing the various operation controls of the air conditioning apparatus 10, comprises the outdoor controller 90*a* and the indoor controller 90*b* joined via a transmission line 90*c* as shown in FIG. 1. As shown in FIG. 2, the controller 90 receives detection signals from the above described various sensors 91-99, and implements control of the various devices including the compressor 20, the outdoor fan 35, the outdoor expansion valve 41, the indoor fan 55, the first electric injection valve 63, the second electric injection valve 84 and the like, based on these detection signals.

The controller 90 is provided with function parts including a cooling operation control part for when the cooling operation is performed, that uses the indoor heat exchanger 50 as an evaporator, a heating operation control part for when the heating operation is performed, that uses the indoor heat exchanger 50 as a condenser, and an injection control part that performs injection control for the cooling operation or the heating operation.

(3) Operation of the Air Conditioning Apparatus

The operation of the air conditioning apparatus 10 according to this embodiment will now be described. The controls for each operation explained subsequently are performed from the controller 90 that functions as a device for operation control.

(3-1) Basic Operations for the Cooling Operation

During the cooling operation the four-way switching valve 15 is in the condition indicated by the solid line in FIG. 1, that is, liquid refrigerant discharged from the compressor 20 flows to the outdoor heat exchanger 30, moreover the suction passage 27 is connected to the gas-side shut off valve 18. With the outdoor expansion valve 41 fully open, the indoor expansion valve 42 comes to be adjusted. Note that the shut off valves 17 and 18 are in the open condition.

With the refrigerant circuit in this condition, the high-pressure gas refrigerant discharged from the compressor 20 is delivered via the four-way switching valve 15 to the outdoor heat exchanger 30 functioning as a condenser of refrigerant, where the refrigerant is cooled by being subjected to heat exchange with outdoor air supplied from the outdoor fan 35. The high-pressure refrigerant cooled in the outdoor heat exchanger 30 and liquefied, becomes refrigerant in a supercooled state at the heat exchanger for injection 64, and is then delivered via the liquid refrigerant communication pipe 13 to each of the indoor units 12. The refrigerant delivered to each of the indoor units 12 is depressurized by the respective indoor expansion valves 42, becoming low-pressure refrigerant in a gas-liquid two-phase state, and is then subjected to heat exchange with indoor air in the indoor heat exchanger 50, functioning as an evaporator of refrigerant, becoming evaporated, and becoming low-pressure gas refrigerant. The low-pressure gas refrigerant heated in the indoor heat exchanger 50 is delivered via the gas refrigerant communication pipe 14 to the outdoor unit 11 and sucked into the compressor 20 again via the four-way switching valve 15. This is how the air conditioning apparatus cools indoors.

In the case in which some of the indoor units 12 from among the indoor units 12 are not operating, the indoor expansion valve 42 of the indoor unit 12 that is not operating has the opening closed (for example completely closed). In this case, almost no refrigerant passes through the indoor unit 12 that has stopped operating and the cooling operation is only carried out in the indoor unit 12 that is operating.

(3-2) Basic Operations During the Heating Operation

During the heating operation the four-way switching valve 15 is in the condition indicated by the dashed line in FIG. 1, that is, the discharge-side refrigerant pipe 29 of the compressor 20 is connected to the gas-side shut off valve 18, moreover, the suction passage 27 is connected to the outdoor heat exchanger 30. The outdoor expansion valve 41 and the indoor expansion valve 42 come to be adjusted. Note that the shut off valves 17 and 18 are in the open condition.

With the refrigerant circuit in this condition, the high-pressure gas refrigerant discharged from the compressor 20 is delivered via the four-way switching valve 15 and the gas refrigerant communication pipe 14 to each of the indoor units 12. The high-pressure gas refrigerant delivered to each of the indoor units 12 is cooled by being subjected to heat exchange with indoor air in the respective indoor heat exchangers 50, each functioning as a condenser of refrigerant. Thereafter the refrigerant passes through the indoor expansion valve 42 and is delivered via the liquid refrigerant communication pipe 13 to the outdoor unit 11. As the refrigerant is subjected to heat exchange with indoor air and cooled, the indoor air is heated. The high-pressure refrigerant delivered to the outdoor unit 11 is separated into liquid and gas at the high-pressure receiver 80, the high-pressure liquid refrigerant comes into a subcooled state at the heat exchanger for injection 64, being depressurized by the outdoor expansion valve 41 to become low-pressure refrigerant in a gas-liquid two-phase state, which is then flowed into the outdoor heat exchanger 30, functioning as an evaporator of refrigerant. The low-pressure refrigerant in a gas-liquid two-phase state flowed into the outdoor heat exchanger 30 is subjected to heat exchange with outdoor air supplied from the outdoor fan 35 and heated, becoming evaporated, low-pressure refrigerant. The low-pressure gas refrigerant exiting from the outdoor heat exchanger 30 is sucked into the compressor 20 again via the four-way switching valve 15. This is how the air conditioning apparatus warms indoors.

(3-3) Injection Control for Each Operation

During the cooling operation and during the heating operation, the injection control part comprising one of the function parts of the controller 90, selectively performs either the first injection control that flows refrigerant to primarily the first injection channel 65, or the second injection control that flows refrigerant to primarily the second injection channel 82. These injection controls are performed in order to reduce the discharge temperature as there is a tendency for the discharge temperature of the compressor 20 using R32 as refrigerant to be high, the refrigerant being delivered to the intermediate injection port 23 of the compressor 20 using the first injection channel 65 or the second injection channel 82, reducing the discharge temperature of the compressor 20. The intermediate-pressure refrigerant delivered to the intermediate injection port 23 is of lower temperature than intermediate-pressure refrigerant in the course of compression in the compressor 20, thereby reducing the discharge temperature of the compressor 20.

The controller 90 normally performs the first injection control. The first injection control flows refrigerant to primarily the first injection channel 65 and is therefore a control that performs intermediate injection. During the first injection control the first electric injection valve 63 functions as an expansion valve, the opening normally being adjusted based on the detected temperature Tsh from the first injection temperature sensor 96. At this time, the opening of the first electric injection valve 63 is adjusted such that the refrigerant flowing in the first injection channel 65 becomes superheated gas, that is, such that the refrigerant becomes refrigerant gas superheated as required. In this way, the discharge temperature of the compressor 20 is reduced and the operating efficiency of the air conditioning apparatus 10 is improved.

The controller 90, in the first injection control monitors the discharge temperature Tdi of the compressor 20 detected by the discharge temperature sensor 93, and if the discharge temperature Tdi exceeds a first upper limit value, stops adjusting the degree of the opening of the first electric injection valve 63 based on the detected temperature Tsh of the first injection temperature sensor 96 and transitions to adjustment of the degree of opening of the first electric injection valve 63 based on the detected temperature Tdi of the discharge temperature sensor 93. At this time the opening of the first electric injection valve 63 is adjusted such that the refrigerant flowing in the first injection channel 65 becomes humid gas (flash gas). If the detected temperature Tdi of the discharge temperature sensor 93 is below the first upper limit value, the controller 90 returns to adjusting the degree of opening of the first electric injection valve 63 based on the detected temperature Tsh of the first injection temperature sensor 96 again. On the other hand, if the detected temperature Tdi of the discharge temperature sensor 93 exceeds a second upper limit value that is higher than the first upper limit value, droop control of the compressor 20 commences, reducing the rotational speed of the compressor 20, moreover if the detected temperature Tdi exceeds a third upper limit value that is still higher than the second upper limit value, an instruction is issued to stop the compressor 20.

Basically, the first injection control lowers the discharge temperature of the compressor 20 and improves the operating efficiency of the air conditioning apparatus 10 as described above, however, the controller 90, through the receiver outlet pressure sensor 92, constantly monitors the pressure Ph2 (outdoor liquid pipe pressure Ph2) of the refrigerant in the vicinity of the connection point of the main refrigerant channel 11*a* with the branch flow pipe 62. When the outdoor liquid pipe pressure Ph2 of the main refrigerant channel 11*a* is lower than a threshold value, the controller 90 switches from the first injection control to the second injection control. This is because if the outdoor liquid pipe pressure Ph2 becomes low, it becomes necessary to considerably reduce the opening degree of the first electric injection valve 63 in order that the refrigerant flowing in the first injection channel 65 becomes superheated gas, and it is not possible to maintain the quantity of injected refrigerant (the quantity of refrigerant flowing into the intermediate injection port 23). In the second injection control, performed when the outdoor liquid pipe pressure Ph2 is below the threshold value, the first electric injection valve 63 is closed and the second electric injection valve 84 is opened instead, the gas component of the refrigerant accumulated inside the high-pressure receiver 80 passes through the second injection channel 82, being supplied from the intermediate injection port 23 to the compressor 20. Because the outdoor liquid pipe pressure Ph2 is low, it often occurs that refrigerant returning to the outdoor unit 11 from the indoor unit 12 is flashed, with the gas component of the refrigerant residing in the high-pressure receiver 80.

In this second injection control it may be possible for the first electric injection valve 63 to not be closed, and to continue adjustment of the opening of the first electric injection valve 63 based on the detected temperature Tsh of the first injection temperature sensor 96. However, as the outdoor liquid pipe pressure Ph2 is below the threshold value, in the second injection control the quantity of refrigerant flowing in the second injection channel 82 becomes larger than the quantity of refrigerant flowing in the first injection channel 65. Further, in the second injection control, the opening of the second electric injection valve 84 is adjusted based on the detected temperature Tdi of the discharge temperature sensor 93.

Note that even when the air conditioning apparatus 10 is started up, in the case in which a small number of the indoor units 12 are operated, as it is envisaged that the discharge temperature of the compressor 20 will rise, intermediate injection is performed at times when predetermined conditions are met. Specifically, the determination on whether or not to implement intermediate injection is dependent on the outside air temperature conditions or conditions of the capacity for thermo-on (the total capacity of the indoor units 12 that flow refrigerant with the indoor expansion valve 42 open). In this case in which intermediate injection is implemented at startup, the control operates such that the opening of the first electric injection valve 63 is gradually increased in order that the compressor 20 does not cause liquid compression.

(4) Characteristics of the Air Conditioning Apparatus (4-1)

The air conditioning apparatus 10 according to this embodiment of the present invention, when performing the first injection control, primarily depressurizes at the first electric injection valve 63 of the branch flow pipe 62, the refrigerant diverged from the main refrigerant channel 11*a*, and heats the refrigerant in the heat exchanger for injection 64. The depressurized, heated refrigerant that has become flash gas in a gas-liquid two-phase state, saturated gas or superheated gas, flows through the first injection channel 65 to the compressor 20, the discharge temperature of the compressor 20 being reduced. On the other hand, when the second injection control is performed, primarily, the gas component (saturated gas) of the refrigerant accumulated inside the high-pressure receiver 80 is flowed through the second injection channel 82 to the compressor 20, operating to lower the discharge temperature of the compressor 20. In this way, the air conditioning apparatus 10 is configured so as to be capable of switching between the first injection control that flows refrigerant primarily in the first injection channel 65, and the second injection control that flows refrigerant primarily in the second injection channel 82.

Accordingly, even in the case in which the pressure of the liquid refrigerant in the outdoor unit 11 that has been diverged from the main refrigerant channel 11*a* is low, and though the refrigerant is heated in the heat exchanger for injection 64 it is not possible to maintain the quantity of the refrigerant flowing from the first injection channel 65 to the compressor 20, it is possible to switch to the second injection control and lower the discharge temperature of the compressor 20. Further, as it is possible to perform the second injection control in addition to the first injection control, it becomes unnecessary to substantially increase the size of the heat exchanger for injection 64 so that the dryness of the refrigerant flowing to the compressor 20 is maintained, regardless of the refrigerant condition, thereby minimizing any increase in the size of the heat exchanger for injection 64 and enabling the function of reducing the discharge temperature of the compressor 20 to be maintained.

(4-2)

In the air conditioning apparatus 10 according to this embodiment, as the quantity of refrigerant required for the cooling operation is sealed in the refrigerant circuit, during the heating operation, while also depending on the condition of load, the high-pressure refrigerant that returns to the outdoor unit 11 flashes easily. However, in the case in which the pressure of the refrigerant about to be flowed to the compressor 20 via the first electric injection valve 63 and the heat exchanger for injection 64 is low (the pressure of refrigerant prior to depressurization at the first electric injection valve 63), it is conceivable that it would not be possible to maintain the dryness and quantity of refrigerant exiting the heat exchanger for injection 64.

In light of this, in the air conditioning apparatus 10, the switching between the first injection control and the second injection control is performed based on the pressure of the refrigerant of the main refrigerant channel 11*a* diverged by the branch flow pipe 62. Specifically, the pressure Ph2 (outdoor liquid pipe pressure Ph2) of the refrigerant in the vicinity of the connection point of the main refrigerant channel 11*a* and the branch flow pipe 62, is constantly monitored by the receiver outlet pressure sensor 92, and when the outdoor liquid pipe pressure Ph2 of the main refrigerant channel 11*a* is below the threshold value, the controller 90 switches from the first injection control to the second injection control. The receiver outlet pressure sensor 92 is disposed in the part of the main refrigerant channel 11*a* between the indoor expansion valve 42 in the role of an expansion mechanism and the outdoor heat exchanger 30 in the role of a condenser in the cooling operation. Further, the receiver outlet pressure sensor 92 is disposed in the part of the main refrigerant channel 11*a* between the outdoor expansion valve 41 in the role of an expansion mechanism and the indoor heat exchanger 50 in the role of a condenser in the heating operation. That is, in the air conditioning apparatus 10, switching between the first injection control and the second injection control is performed based on the pressure of refrigerant in the main refrigerant channel 11*a* between the condenser and the expansion mechanism.

In this way, even in the case in which intermediate injection using the first injection channel 65 is largely not able to be performed, the gas component of the refrigerant accumulated in the high-pressure receiver 80 comes to be supplied after passing through the second injection channel 82, to the intermediate injection port 23 of the compressor 20, thereby enabling the discharge temperature of the compressor 20 to be lowered. This air conditioning apparatus 10 envisages switching from the first injection control to the second injection control particularly in the heating operation.

Note that the controller 90, basically through the first injection control, reduces the discharge temperature of the compressor 20 and improves the operating efficiency of the air conditioning apparatus 10. This is because by adjusting the opening of the first electric injection valve 63, the refrigerant that flows in the first injection channel 65 and is subject to intermediate injection, can be made into superheated gas and can also be made into humid gas (flash gas). The controller 90, in the first injection control, stops adjusting the opening degree of the first electric injection valve 63 based on the detected temperature Tsh of the first injection temperature sensor 96 if the discharge temperature Tdi exceeds the first upper limit value, and transitions to adjusting the opening degree of the first electric injection valve 63 based on the detected temperature Tdi of the discharge temperature sensor 93, such that humid gas that has high cooling effect flows in the first injection channel 65 and is subject to intermediate injection. Further, the second injection control, in the case in which the pressure of high-pressure refrigerant returning to the outdoor unit 11 becomes low, could be said to be the preferable control as it enables gas to be simply ensured at the high-pressure receiver 80, on the other hand because only saturated gas can be subject to intermediate injection, the cooling effect is low. Moreover, in the case of intentionally dropping the pressure of high-pressure refrigerant that is returned to the outdoor unit 11 for the purpose of the second injection control, when the indoor expansion valve 42 cannot shut perfectly, a large amount of the refrigerant will flow at different pressures in an indoor unit 12 in the thermo-off condition or an indoor unit 12 that is stopped in the heating operation, leading to wasteful energy consumption due to superfluous heating. Accordingly, the air conditioning apparatus 10 according to this embodiment, primarily through the first injection control, reduces the discharge temperature of the compressor 20 and improves the operating efficiency of the air conditioning apparatus 10.

(4-3)

The air conditioning apparatus 10 according to this embodiment of the present invention operates such that refrigerant flowing in each of the first injection channel 65 and the second injection channel 82 is caused to merge with intermediate-pressure refrigerant inside the compressor 20, thereby suppressing the rotational speed of the compressor 20 while maintaining capacity, providing improved operating efficiency.

(5) Modifications (5-1) Modification A

In the air conditioning apparatus 10 according to the above described embodiment, the pressure Ph2 (outdoor liquid pipe pressure Ph2) of the refrigerant is continually monitored by the receiver outlet pressure sensor 92 in the vicinity of the connection point of the main refrigerant channel 11*a* and the branch flow pipe 62, and switching between the first injection control and the second injection control is performed based on that outdoor liquid pipe pressure Ph2. It is also possible however, to not have the receiver outlet pressure sensor 92 installed and to estimate the outdoor liquid pipe pressure. For example, it is possible to obtain the quantity of circulating refrigerant from the operating frequency of the compressor 20, the pressure of low-pressure refrigerant in the suction passage 27 or the pressure of high-pressure refrigerant discharged from the compressor 20 (detected value from the discharge pressure sensor 91), calculate the amount of depressurization in the indoor expansion valve 42 or the outdoor expansion valve 41, then calculate the refrigerant pressure in the vicinity of the heat exchanger for injection 64 of the main refrigerant channel 11*a* from that amount of depressurization and the difference between the high and low pressures. It is also possible to install a pressure gauge to detect the pressure of low-pressure refrigerant in the suction passage 27, or to calculate from the refrigerant saturation temperature or the like.

(5-2) Modification B

In the above described embodiment, switching between the first injection control and the second injection control is performed based on the pressure of the refrigerant (outdoor liquid pipe pressure Ph2) in the vicinity of the connection point of the main refrigerant channel 11*a* and the branch flow pipe 62, however it is also possible for the switching to be performed based on a detected value related to the outdoor liquid pipe pressure Ph2, rather than being based on an estimated value or detected value of the outdoor liquid pipe pressure Ph2 itself. For example, in the case in which it is determined from the temperature (value detected by the first injection temperature sensor 96) and the pressure of refrigerant after depressurized at the first electric injection valve 63 and the refrigerant has been subject to heat exchange at the heat exchanger for injection 64, that the dryness of refrigerant or the quantity of refrigerant flow at the intermediate injection from the first injection channel 65 is outside the desired range, it is possible to recognize that the outdoor liquid pipe pressure Ph2 is decreased and to change from the first injection control to the second injection control.

(5-3) Modification C

Figure 4:
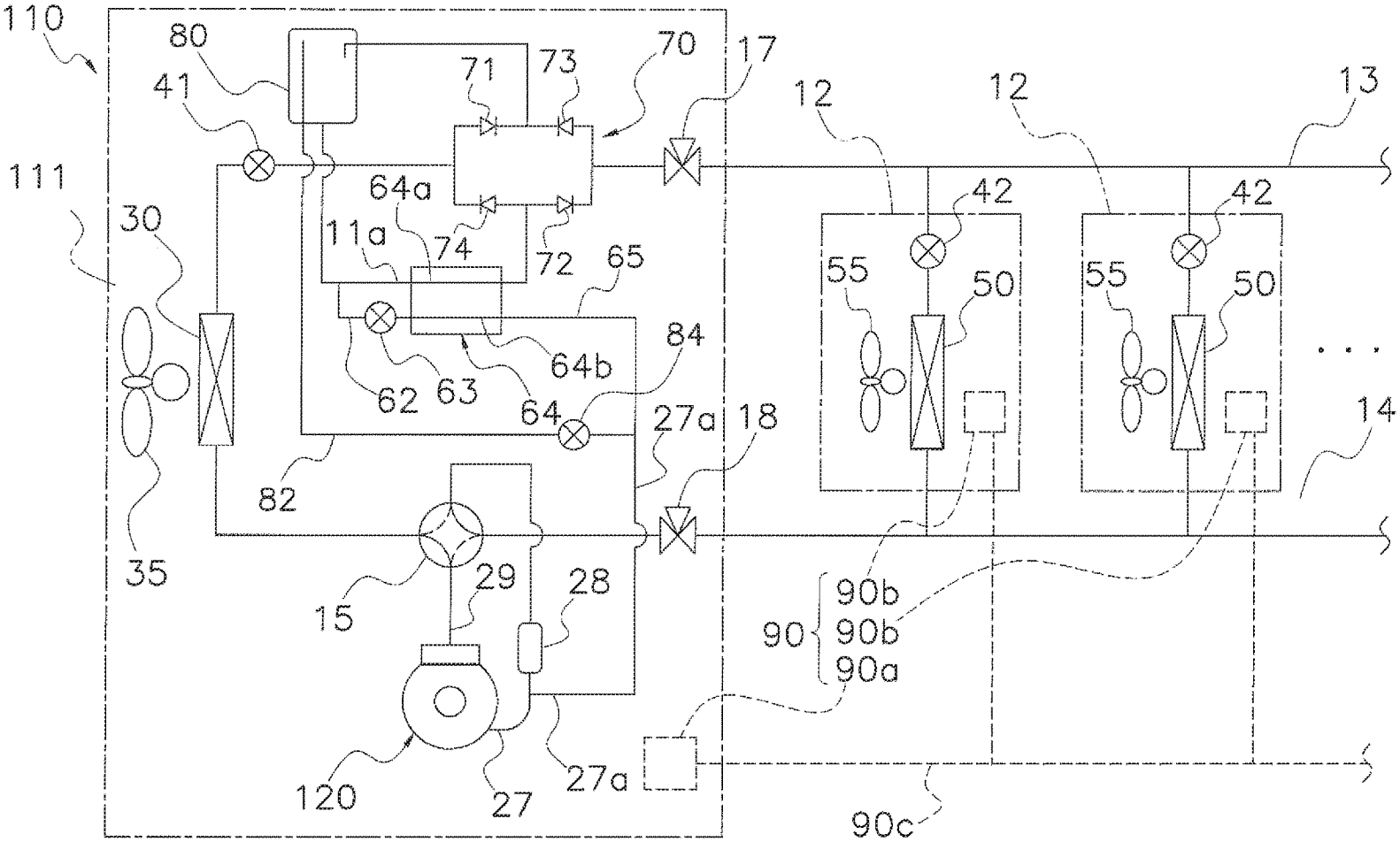
FIG. 4 shows the refrigerant piping system of the air conditioning apparatus according to Modification C.

In the air conditioning apparatus 10 according to the above described embodiment, intermediate injection is performed in which refrigerant flowing in each of the injection channels 65 and 82 is flowed into the intermediate injection port 23 of the compressor 20, however as shown in FIG. 4, it is also possible to reduce the discharge temperature of the compressor 20 by flowing the refrigerant flowing in each of the injection channels 65 and 82 into the suction passage 27.

An air conditioning apparatus 110 shown in FIG. 4 replaces the outdoor unit 11 of the air conditioning apparatus 10 in the above described embodiment with an outdoor unit 111. The outdoor unit 111 has a compressor 120 instead of the compressor 20 of the outdoor unit 11, and changes the connecting ends of the first injection channel 65 and the second injection channel 82 to the suction passage 27.

The compressor 120 of the outdoor unit 111 sucks in refrigerant gas from the suction passage 27 via the vessel 28 appurtenant to the compressor and discharges compressed, high-pressure refrigerant to the refrigerant pipe 29, such that an intermediate injection port is not provided. Further, in the outdoor unit 111, the end of the second injection channel 82 extending toward the compressor 120 from the high-pressure receiver 80 and the end of the first injection channel 65 extending towards the compressor 120 from the heat exchanger for injection 64, connect to a merge pipe 27*a*. As shown in FIG. 4, the end of the merge pipe 27*a* connects to the suction passage 27. Thus the refrigerant that has flowed through each of the injection channels 65 and 82 merges with low-pressure gas refrigerant flowing in the suction passage 27 and comes to be sucked into the compressor 120. In this case also, it is possible to reduce the discharge temperature of the compressor 120 using injection control. Further, the switch between the first injection control and the second injection control can be performed in the same way as in the above described embodiment, moreover, the same effects as are achieved in the above described embodiment are realized.

Second Embodiment (1) Configuration of the Air Conditioning Apparatus

Figure 5:
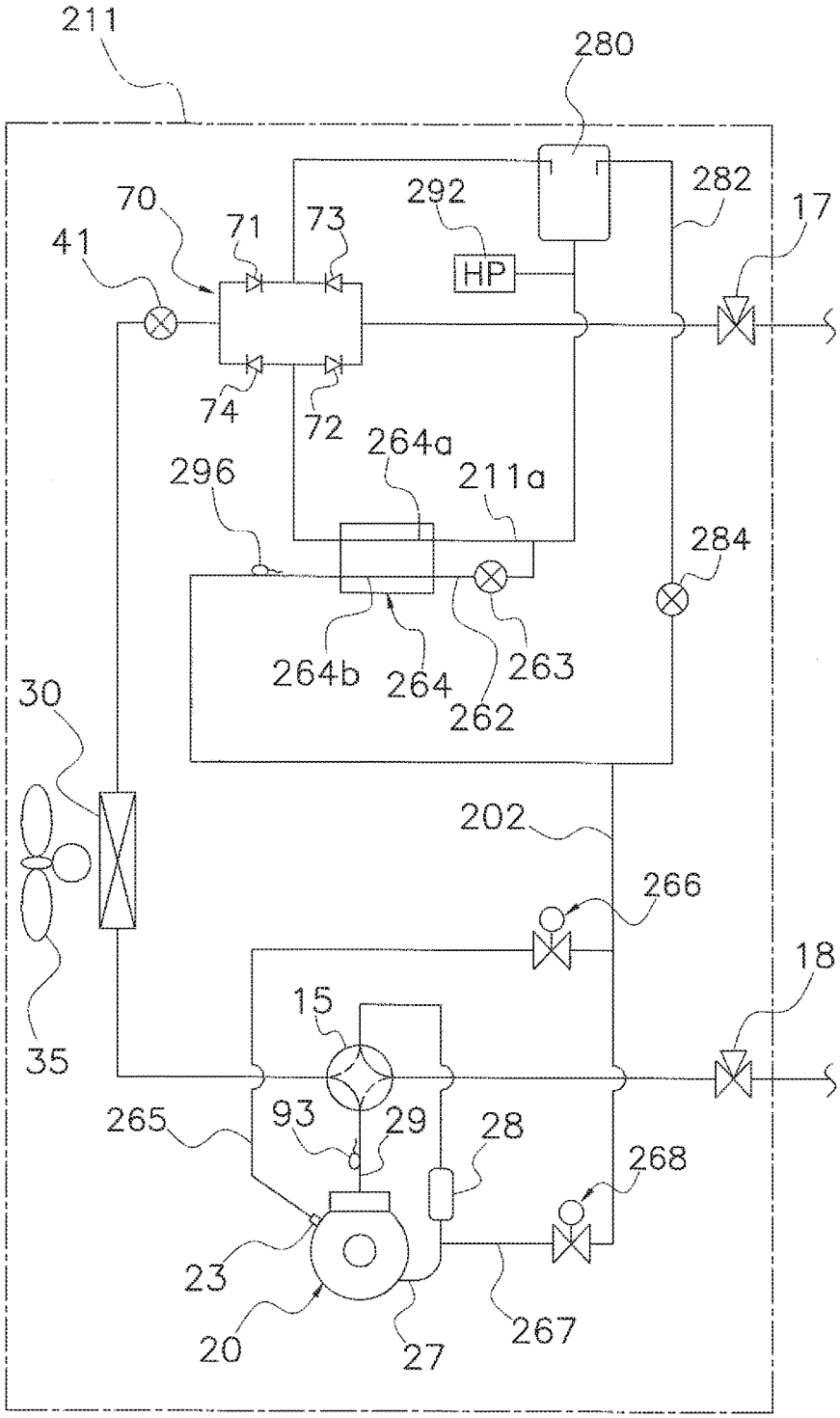
FIG. 5 shows the refrigerant piping system of the air conditioning apparatus according to the second embodiment of the present invention.
Figure 6A:
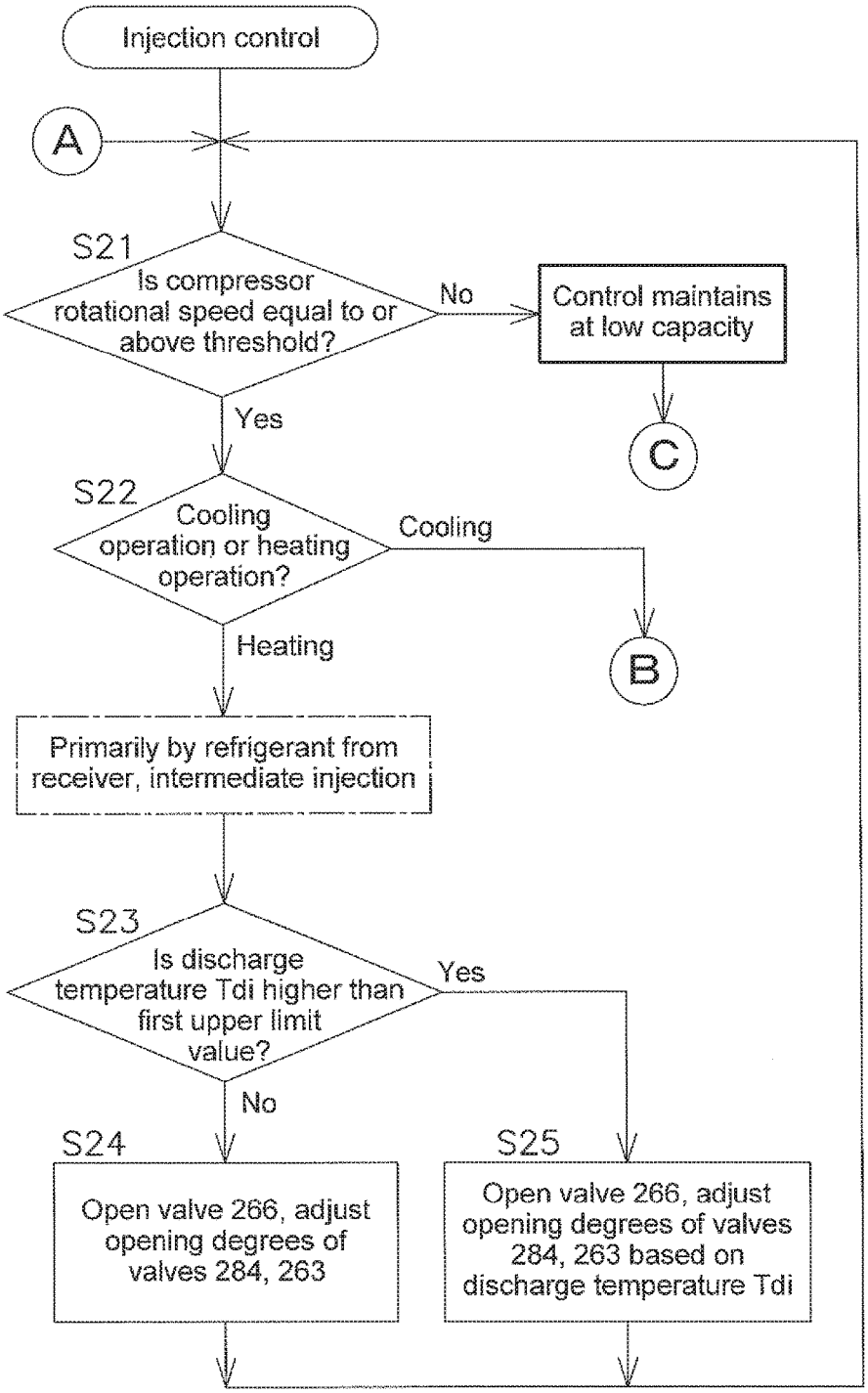
FIG. 6A illustrates the injection control flow of the air conditioning apparatus according to the second embodiment.
Figure 6B:
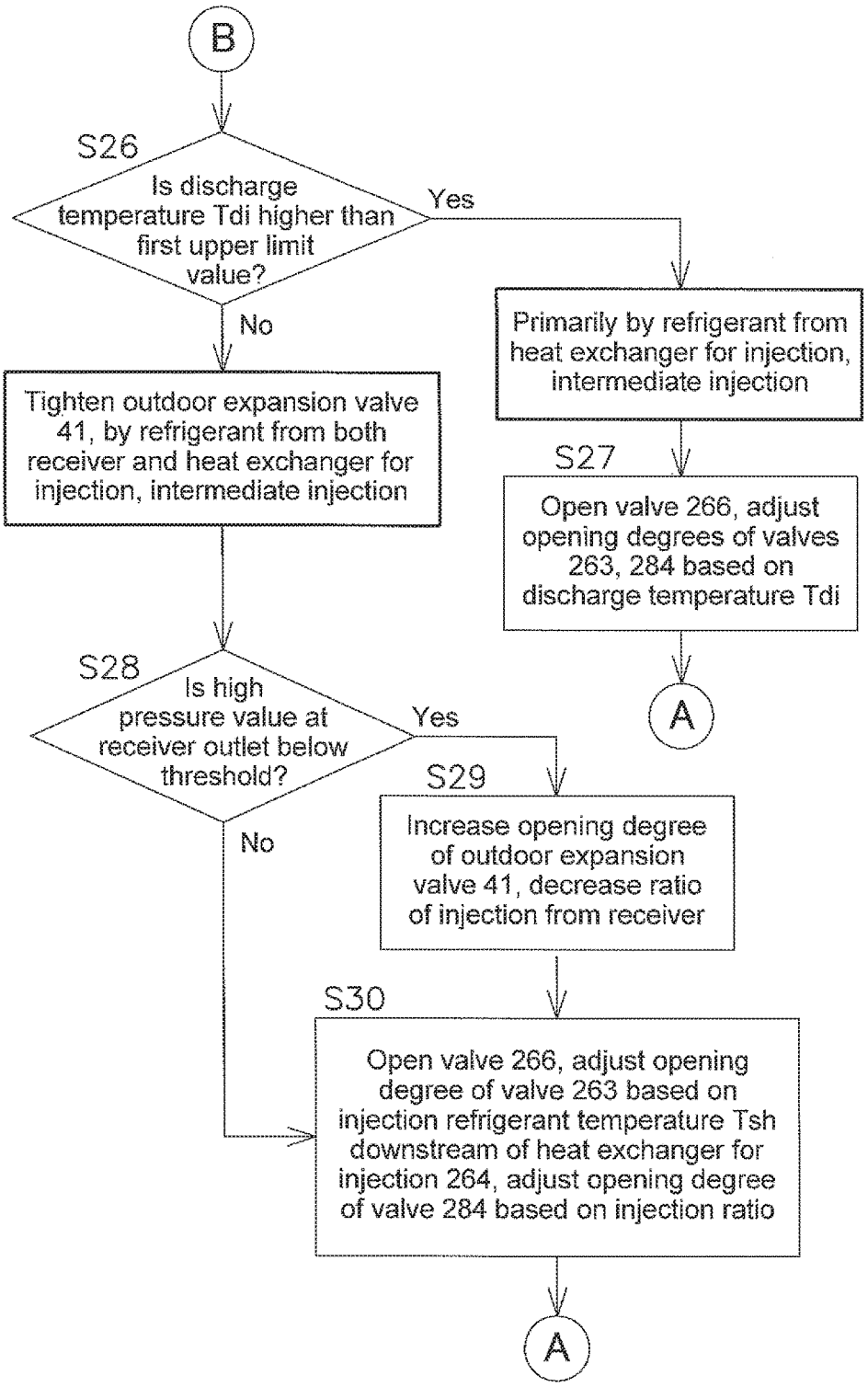
FIG. 6B illustrates the injection control flow of the air conditioning apparatus according to the second embodiment.
Figure 6C:
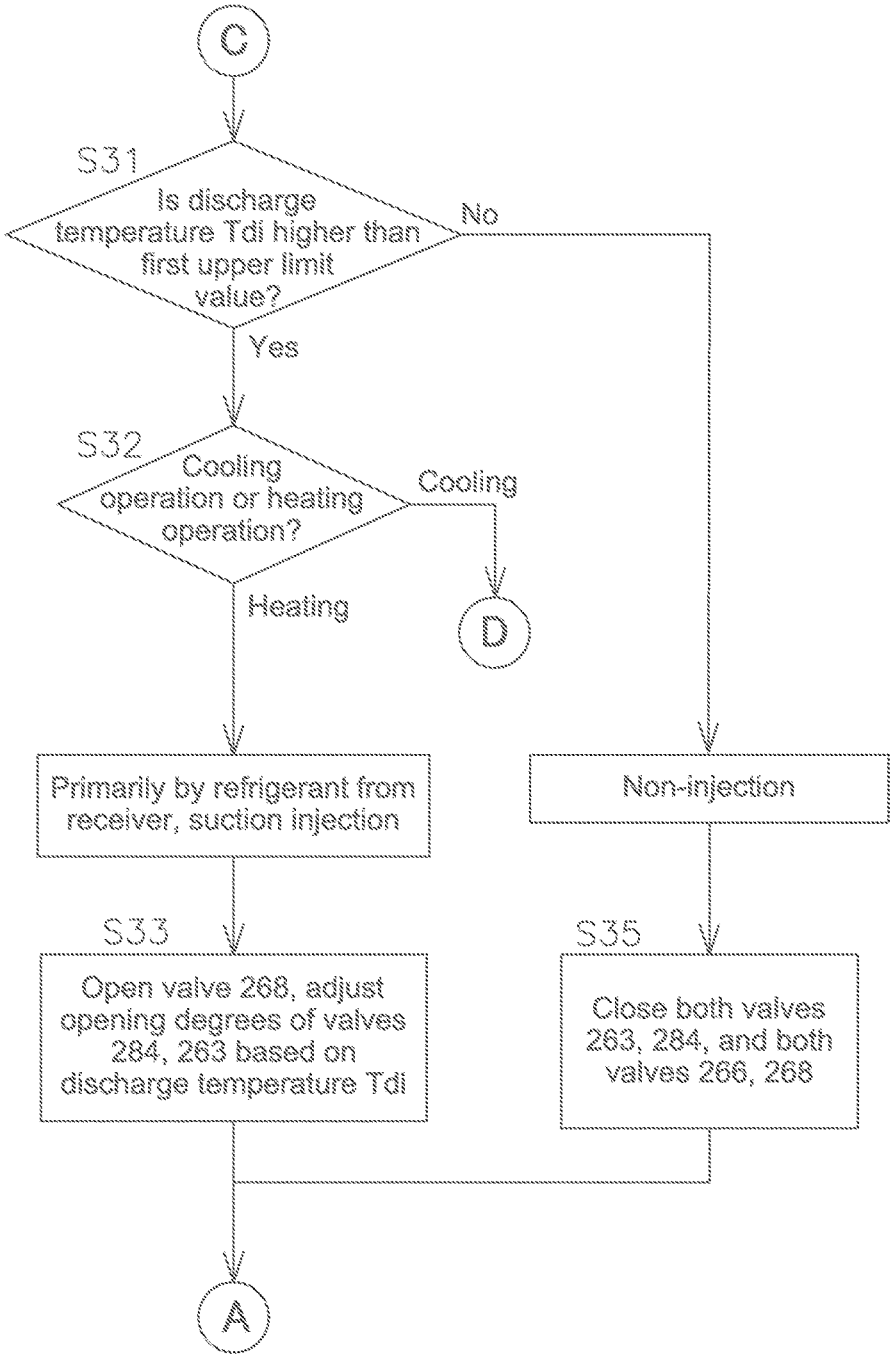
FIG. 6C illustrates the injection control flow of the air conditioning apparatus according to the second embodiment.
Figure 6D:
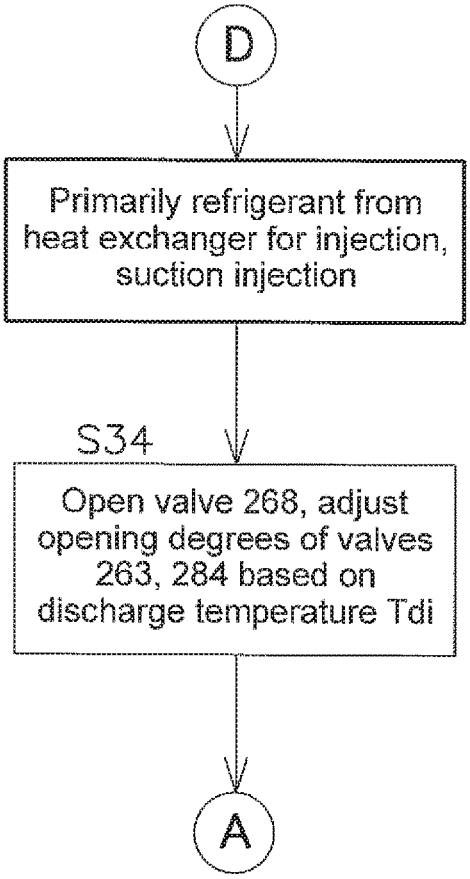
FIG. 6D illustrates the injection control flow of the air conditioning apparatus according to the second embodiment.

In the air conditioning apparatus according to the second embodiment of the present invention, the outdoor unit 11 of the air conditioning apparatus 10 in the above described first embodiment using R32 as the refrigerant, is replaced by an outdoor unit 211 shown in FIG. 5. In this air conditioning apparatus according to the second embodiment, the outdoor unit 211 is disposed in a position lower than the indoor unit 12, and there is a substantial difference between the positional height of the outdoor unit 211 and the positional height of the highest part of the indoor unit 12, such that there is substantial difference in their respective elevations. The outdoor unit 211 will now be described, some of those elements which are substantially similar to the corresponding elements of the outdoor unit 11 in the first embodiment described above will be given the same reference numerals in the figures and their description is omitted.

The outdoor unit 211 has primarily, the compressor 20, the four way switching valve 15, the outdoor heat exchanger 30, the outdoor expansion valve 41, the bridge circuit 70, a high-pressure receiver 280, a first electric injection valve 263, a heat exchanger for injection 264, a second electric injection valve 284, an intermediate injection switching valve 266, a suction injection switching valve 268, the liquid-side shut off valve 17 and the gas-side shut off valve 18.

The compressor 20, the vessel 28 appurtenant to the compressor, the suction passage 27, the discharge-side refrigerant pipe 29 of the compressor 20, the discharge temperature sensor 93, the intermediate injection port 23, the four-way switching valve 15, the liquid-side shut off valve 17, the gas-side shut off valve 18, the outdoor heat exchanger 30, the outdoor expansion valve 41, the outdoor fan 35 and the bridge circuit 70 are the same as their corresponding members in the first embodiment, accordingly their descriptions are omitted.

The high-pressure receiver 280 is a vessel that functions as a refrigerant storage tank, and is disposed between the outdoor expansion valve 41 and the liquid-side shut off valve 17. The high-pressure receiver 280, into which high-pressure refrigerant flows during the cooling operation and during the heating operation, does not have the problem in which the excess refrigerant including refrigerant oil separates into two layers, with the refrigerant oil collecting in the upper portion, as the temperature of excess refrigerant accumulated therein is maintained relatively high. A receiver outlet pressure sensor 292 is provided to the receiver outlet pipe that extends from the lower portion of the high-pressure receiver 280 to the heat exchanger for injection 264. The receiver outlet pipe is part of the main refrigerant channel 211*a* described subsequently. The receiver outlet pressure sensor 292 is a sensor that detects a pressure value (high-pressure value) for high-pressure liquid refrigerant.

Liquid refrigerant normally resides in the lower part of the internal space of the high-pressure receiver 280, and gas refrigerant normally resides in the upper part of that space, while a bypass channel 282 extends from that upper part of the internal space toward the compressor 20. The bypass channel 282 is a pipe that plays the role of guiding the gas component of refrigerant accumulated inside the high-pressure receiver 280 to the compressor 20. A second bypass electric injection valve 284 having an adjustable opening, is provided in the bypass channel 282. When this second bypass electric injection valve 284 opens, gas refrigerant flows via a common injection tube 202 to an intermediate injection channel 265 or a suction injection channel 267 described subsequently.

A heat exchanger for injection 264 is provided between the outlet check valves 72 and 74 of the bridge circuit 70 and the outlet of the high-pressure receiver 280. Further, a branch flow pipe 262 branches from a part of the main refrigerant channel 211*a* that connects the outlet of the high-pressure receiver 280 and the heat exchanger for injection 264. The main refrigerant channel 211*a* is the main channel for liquid refrigerant, and connects the outdoor heat exchanger 30 and the indoor heat exchanger 50.

The first electric injection valve 263, having an adjustable opening, is disposed in the branch flow pipe 262. The branch flow pipe 262 is attached to a second flow path 264*b* of the heat exchanger for injection 264. That is, when the first electric injection valve 263 is open, refrigerant diverged from the main refrigerant channel 211*a* to the branch flow pipe 262 is depressurized at the first electric injection valve 263 and flows to the second flow path 264*b* of the heat exchanger for injection 264.

The refrigerant depressurized at the first electric injection valve 263 and flowed to the second flow path 264*b* of the heat exchanger for injection 264 is subject to heat exchange with refrigerant flowing in a first flow path 264*a* of the heat exchanger for injection 264. The refrigerant that flows through the branch flow pipe 262 after heat exchange at the heat exchanger for injection 264, flows via the shared injection tube 202 and into the intermediate injection channel 265 or the suction injection channel 267 described subsequently. An injection temperature sensor 296 for detecting the temperature of refrigerant after heat exchange at the heat exchanger for injection 264, is mounted to the down flow side of the heat exchanger for injection 264 of the branch flow pipe 262.

The heat exchanger for injection 264 is an internal heat exchanger employing a double tube structure. One end of the first flow path 264*a* connects to the outlet of the high-pressure receiver 280, and the other end of the first flow path 264*a* connects to the outlet check valves 72 and 74 of the bridge circuit 70.

The common injection tube 202 is a pipe connecting to an end of the bypass channel 282 extending from the high-pressure receiver 280 and an end of the branch flow pipe 262 extending from the main refrigerant channel 211*a* via the heat exchanger for injection 264, and connecting to the intermediate injection switching valve 266 and the suction injection switching valve 268. If at least one from among the first electric injection valve 263 and the second bypass electric injection valve 284 is open, and either the intermediate injection switching valve 266 or the suction injection switching valve 268 opens, refrigerant flows in the common injection tube 202, and intermediate injection or suction injection is implemented.

The intermediate injection channel 265 extends from the intermediate injection switching valve 266 connected to the common injection tube 202, to the compressor 20. Specifically, one end of the intermediate injection channel 265 is connected to the intermediate injection switching valve 266, and the other end of the intermediate injection channel 265 is connected to the intermediate injection port 23 of the compressor 20.

The suction injection channel 267 extends from the suction injection switching valve 268 connected to the common injection tube 202 to the suction passage 27. Specifically, one end of the suction injection channel 267 is connected to the suction injection switching valve 268, and the other end of the suction injection channel 267 is connected to the part of the suction passage 27 connecting the vessel 28 appurtenant to the compressor and the compressor 20.

The intermediate injection switching valve 266 and the suction injection switching valve 268 are solenoid valves that switch between an open condition and a closed condition.

(2) Operation of the Air Conditioning Apparatus

The operation of the air conditioning apparatus according to the second embodiment of the present invention will now be described. The controls for each operation explained subsequently are performed by the control unit of the outdoor unit 211 that functions as a means for operation control.

(2-1) Basic Operations for the Cooling Operation

During the cooling operation the four-way switching valve 15 is in the condition indicated by the solid line in FIG. 5, that is, gas refrigerant discharged from the compressor 20 flows to the outdoor heat exchanger 30, moreover the suction passage 27 is connected to the gas-side shut off valve 18. With the outdoor expansion valve 41 in the fully open condition, the degree of opening of the indoor expansion valve 42 comes to be adjusted. Note that the shut off valves 17 and 18 are in the open condition.

With the refrigerant circuit in this condition, the high-pressure gas refrigerant discharged from the compressor 20 is delivered via the four-way switching valve 15 to the outdoor heat exchanger 30 functioning as a condenser of refrigerant, where the refrigerant is cooled by being subjected to heat exchange with outdoor air supplied from the outdoor fan 35. The liquefied high-pressure refrigerant cooled in the outdoor heat exchanger 30, becomes refrigerant in a subcooled state at the heat exchanger for injection 264, and is then delivered to each of the indoor units 12. The operation of each of the indoor units 12 is the same as in the first embodiment described above. Low-pressure gas refrigerant returning to the outdoor unit 11 from each of the indoor units 12 is sucked into the condenser 20 again, via the four-way switching valve 15. Basically, this is how the air conditioning apparatus cools indoors.

(2-2) Basic Operations for the Heating Operation

During the heating operation the four-way switching valve 15 is in the condition shown by the dashed line in FIG. 5, that is the discharge-side refrigerant pipe 29 of the compressor 20 is connected to the gas-side shut off valve 18, moreover the suction passage 27 is connected to the outdoor heat exchanger 30. The degrees of opening of the outdoor expansion valve 41 and the indoor expansion valve 42 come to be adjusted. Note that the shut off valves 17 and 18 are in the open condition.

With the refrigerant circuit in this condition, high-pressure gas refrigerant discharged from the compressor 20 passes via the four-way switching valve 15 and the gas refrigerant communication pipe 14 and is delivered to each of the indoor units 12. The operation of each of the indoor units 12 is the same as for the first embodiment described above. The high-pressure refrigerant returning to the outdoor unit 11 again, passes via the high-pressure receiver 280 and becomes refrigerant in a subcooled state at the heat exchanger for injection 264, flowing to the outdoor expansion valve 41. The refrigerant depressurized at the outdoor expansion valve 41 and now low-pressure refrigerant in a gas-liquid two-phase state, flows into the outdoor heat exchanger 30 functioning as an evaporator. The low-pressure, gas-liquid two-phase state refrigerant that flows into the outdoor heat exchanger 30 is heated by being subject to heat exchange with outdoor air supplied from the outdoor fan 35, and is evaporated, becoming low-pressure refrigerant. The low-pressure gas refrigerant coming out of the outdoor heat exchanger 30 passes via the four-way switching valve 15 and is sucked into the compressor 20 again. Basically, this is how the air conditioning apparatus heats indoors.

(2-3) Injection Control for Each Operation

During the cooling operation and during the heating operation, the control unit performs intermediate injection or suction injection, the object being to improve operating capacity or decrease the discharge temperature of the compressor 20. Intermediate injection means that the refrigerant that has flowed into the common injection tube 202 from the heat exchanger for injection 264 and/or the high-pressure receiver 280, flows through the intermediate injection channel 265 and is injected into the intermediate injection port 23 of the compressor 20. Suction injection means that the refrigerant that has flowed into the common injection tube 202 from the heat exchanger for injection 264 and/or the high-pressure receiver 280, is injected into the suction passage 27 by way of the suction injection channel 267 and caused to be sucked into the compressor 20. Both intermediate injection and suction injection have the effect of decreasing the discharge temperature of the compressor 20. Intermediate injection has the further effect of improving operating capacity.

The control unit performs injection control based on the rotational speed (or frequency) of the inverter controlled compressor 20, the discharge temperature Tdi of refrigerant detected from the discharge temperature sensor 93 with respect to refrigerant discharged from the compressor 20, and the temperature of injected refrigerant as detected by the injection temperature sensor 296 to the downstream side of the heat exchanger for injection 264. Specifically, the control unit implements intermediate injection control that causes intermediate injection, or implements suction injection control that causes suction injection. Further, when the conditions are such that the control unit should not perform either intermediate injection or suction injection, neither form of injection is performed and operations are carried out in the non-injection condition. In other words, the control unit may selectively perform intermediate injection control, suction injection control, or non-injection control, in which neither form of injection is implemented.

The flow of injection control from the control unit will now be described with reference to FIG. 6A through FIG. 6D.

Firstly, at step S21, the control unit determines whether the rotational speed of the compressor 20 is above or below a predetermined threshold. The predetermined threshold is set for example, at a significantly low rotational speed, a value below which a lower rotational speed could not be set, or, a value at which, were the rotational speed to be lowered even further, there would be a decrease in the efficiency of the compressor motor.

(2-3-1) Intermediate Injection Control

If the control unit determines at step S21 that the rotational speed of the compressor 20 is greater than or equal to the threshold, the control unit transitions to step S22 to determine whether the air conditioning apparatus is performing the cooling operation or the heating operation. In the case of the heating operation, intermediate injection is performed, that flows gas refrigerant taken from primarily the high-pressure receiver 280, to the intermediate injection channel 265.

(2-3-1-1) Intermediate Injection Control During Heating

If the determination at step S22 is that the air conditioning apparatus is in the heating operation, the control unit transitions to step S23 and determines whether or not the discharge temperature Tdi of refrigerant discharged from the compressor 20 as detected by the discharge temperature sensor 93, is higher than the first upper limit value. The first upper limit value can be set at for example 95° C. If the discharge temperature is not higher than the first upper limit value, the control unit transitions to step S24 and puts the intermediate injection switching valve 266 into the open condition and the suction injection switching valve 268 into the closed condition. If those valves are already in those respective conditions, the valves are maintained as they are. Further, at step S24 the respective degrees of opening of the first electric injection valve 263 and the second bypass electric injection valve 284 are adjusted. As the discharge temperature Tdi is in the normal range, the opening of the first electric injection valve 263 is adjusted, in accordance with basic heating operation control, such that liquid refrigerant out from the high-pressure receiver 280 and flowing in the main refrigerant channel 211*a* reaches a predetermined degree of subcooling. Moreover, the opening of the second bypass electric injection valve 284 is adjusted such that the gas refrigerant in the high-pressure receiver 280, flows to the intermediate injection channel 265. On the other hand, if, at step S23, the control unit determines that the discharge temperature Tdi is higher than the first upper limit value, step S25 is transitioned to. Here, as it is necessary to reduce the discharge temperature Tdi, the respective openings of the first electric injection valve 263 and the second bypass electric injection valve 284 are adjusted based on that discharge temperature Tdi. Specifically, at step S25, moisture control is performed that moistens gas refrigerant to be subject to intermediate injection such that the discharge temperature Tdi can be swiftly brought below the first upper limit value. That is, in order to raise the cooling effect of intermediate injection, the opening of the first electric injection valve 263 and the like is adjusted such that gas refrigerant for intermediate injection becomes gas-liquid, two-phase flash gas.

(2-3-1-2) Intermediate Injection Control During Cooling

If the determination at step S22 is that the air conditioning apparatus is in the cooling operation, the control unit transitions to step S26 and determines whether or not the discharge temperature Tdi is higher than the first upper limit value. If the discharge temperature Tdi is higher than the first upper limit value, the control unit transitions to step S27, and in order to perform moisture control that moistens gas refrigerant to be subject to intermediate injection, refrigerant flows from primarily the heat exchanger for injection 264 to the intermediate injection channel 265. Specifically, at step S27, the intermediate injection switching valve 266 is put into the open condition and the suction injection switching valve 268 is put into the closed condition, further, the degree of opening of the first electric injection valve 263 is controlled based on the discharge temperature Tdi. Moreover, at step S27, the second bypass electric injection valve 284 is opened as required. At this step S27, moist gas refrigerant in a gas-liquid two-phase state from the heat exchanger for injection 264 is subject to intermediate injection to the compressor 20, and the elevated discharge temperature Tdi can be expected to decrease rapidly.

At step S26, if the discharge temperature Tdi is lower than the first upper limit value the control unit determines there is no necessity to lower the discharge temperature Tdi, and intermediate injection is performed using both refrigerant from the high-pressure receiver 280 and refrigerant from the heat exchanger for injection 264. Specifically, the system transitions via step S28 or step S29 to step S30, the intermediate injection switching valve 266 is put into the open condition, the suction injection switching valve 268 is put into the closed condition, moreover the degree of opening of the first electric injection valve 263 and the degree of opening of the second bypass electric injection valve 284 are adjusted. At step S28 the control unit determines whether or not a high-pressure value of liquid refrigerant detected by the receiver outlet pressure sensor 292 at the outlet of the high-pressure receiver 280 is below a threshold value. This threshold value is an initially set value, based on for example the elevational difference (difference in the height of their respective places of installation) between the outdoor unit 211 and the indoor unit 12 of the air conditioning apparatus, and is set such that if the high-pressure value is lower than this threshold value, prior to passing through the indoor expansion valve 42 of the indoor unit 12, the refrigerant would become refrigerant in a flash gas state and the sound of passing refrigerant would increase substantially. If it is determined at step S28 that the high-pressure value is below the threshold value, as it is necessary to increase the high-pressure value, the outdoor expansion valve 41 in a state of being slightly constricted, is opened more, relieving the degree of depressurization by the outdoor expansion valve 41. Thus, the gas component of refrigerant in the high-pressure receiver 280 is reduced, the quantity of gas refrigerant from the high-pressure receiver 280 comprising the total quantity of refrigerant for injection decreases, and the ratio of injection from the high-pressure receiver 280 becomes smaller. On the other hand, if at step S28 the high-pressure value exceeds the threshold value, the system transitions to step S30 maintaining that injection ratio. At step S30, in the same manner as above, the intermediate injection switching valve 266 is open, and both refrigerant flowing from the high-pressure receiver 280 and refrigerant flowing from the heat exchanger for injection 264 flow from the intermediate injection channel 265 to the intermediate injection port 23 of the compressor 20. Moreover at step S30 the degree of opening of the first electric injection valve 263 is adjusted based on the temperature Tsh of refrigerant used for injection, to the down flow side of the heat exchanger for injection 264, further, based on the injection ratio, the opening of the second bypass electric injection valve 284 is adjusted in conjunction with the degree of opening of the outdoor expansion valve 41.

(2-3-2) Control to Maintain Low Capacity

From step S22 up to step S30 above, relates to control when it is determined at step S21 that the rotational speed of the compressor 20 is greater than or equal to the threshold value, however as there is room to drop the rotational speed of the compressor 20 further lowering capacity, basically improved operating capacity is achieved through injection. Accordingly, intermediate injection is selected and not suction injection.

However, if at step S21 it is determined that the rotational speed of the compressor 20 is less than the threshold value, this means that the compressor 20 has already dropped to low capacity, and as raising the operating capacity right up would be contrary to the needs of users, control is implemented to maintain the capacity of the compressor 20 as it is, in that low capacity condition.

(2-3-2-1) Suction Injection Control

If at step S21 it is determined that the rotational speed of the compressor 20 is below the threshold value, the control unit transitions to step S31 and the determination is made whether or not the discharge temperature Tdi is higher than the first upper limit value. If the discharge temperature Tdi is higher than the first upper limit value, as it is needed to lower the discharge temperature Tdi, step S33 or step S34 is transitioned to, and suction injection is implemented.

(2-3-2-1-1) Suction Injection Control During the Heating Operation

If it is determined at step S31 that the discharge temperature Tdi is higher than the first upper limit value, moreover at step S32 it is determined that the heating operation is being performed, suction injection is performed in which primarily refrigerant from the high-pressure receiver 280 flows from the suction injection channel 267 to the suction passage 27. Specifically, at step S33, the intermediate injection switching valve 266 is put into the closed condition and the suction injection switching valve 268 is put into the open condition. Then, based on the discharge temperature Tdi, the degree of opening of the second bypass electric injection valve 284 is adjusted such that gas refrigerant accumulated in the high-pressure receiver 280 in the heating operation flows mostly to the suction injection channel 267, further, the degree of opening of the first electric injection valve 263 is adjusted such that refrigerant flowing from the heat exchanger for injection 264 to the suction injection channel 267 becomes flash gas.

(2-3-2-1-2) Suction Injection Control During the Cooling Operation

If it is determined at step S31 that the discharge temperature Tdi is higher than the first upper limit value, moreover at step S32 it is determined that the cooling operation is being performed, suction injection is performed in which primarily refrigerant from the heat exchanger for injection 264 flows to the suction injection channel 267. Specifically, at step S34, the intermediate injection switching valve 266 is put into the closed condition and the suction injection switching valve 268 is put into the open condition. Then, based on the discharge temperature Tdi, the degree of opening of the first electric injection valve 263 is adjusted such that refrigerant flowing from the heat exchanger for injection 264 to the suction injection channel 267 becomes flash gas. Further at step S34, the second bypass electric injection valve 284 is opened as necessary.

(2-3-2-2) Non-Injection Control

If at step S31 the discharge temperature Tdi is lower than the first upper limit value, it is determined that it is not necessary to reduce the discharge temperature Tdi, and the control unit selects the non-injection condition. That is, intermediate injection and suction injection in order to lower the discharge temperature Tdi and intermediate injection in order to improve operation capacity are not required, and as it is desirable to stop those forms of injection, the non-injection condition is implemented. At step S35, the control unit puts the intermediate injection switching valve 266 and the suction injection switching valve 268 into the closed condition, and adjusts the degree of opening of the first electric injection valve 263 and the degree of opening of the second bypass electric injection valve 284 to the minimum. When the minimum degree of opening is zero, the first electric injection valve 263 and the second electric injection valve 284 are in the completely closed condition.

Thus, in the air conditioning apparatus according to this second embodiment of the present invention, it is not necessary to lower the discharge temperature of the compressor 20 by intermediate injection or suction injection as the discharge temperature Tdi is low, moreover, in the case in which the rotational speed of the compressor 20 is decreased as low capacity is required, the non-injection control is selected and implemented. Thus, increase of capacity through intermediate injection or suction injection and the occurrence of decreased operating efficiency are minimized, and in this air conditioning apparatus according to the second embodiment, it is possible to maintain operating efficiency while satisfying the requirement of low capacity.

What is claimed is:

1. A refrigeration apparatus that uses R32 as the refrigerant, the refrigeration apparatus comprising:

a compressor arranged and configured to suck in low-pressure refrigerant from a suction passage, compress the refrigerant and discharge high-pressure refrigerant;

a condenser arranged and configured to condense the high-pressure refrigerant discharged from the compressor;

an expansion mechanism arranged and configured to expand the high-pressure refrigerant exiting the condenser;

an evaporator arranged and configured to evaporate the refrigerant expanded by the expansion mechanism;

a branch flow channel branching from a main refrigerant channel joining the condenser and the evaporator;

a first opening adjustable valve having an adjustable opening and disposed along the branch flow channel;

an injection heat exchanger arranged and configured to exchange heat between the refrigerant that flows in the main refrigerant channel and the refrigerant that passes through the first opening adjustable valve of the branch flow channel;

a first injection channel arranged and configured to guide the refrigerant that flows in the branch flow channel and that exits from the injection heat exchanger to the compressor or the suction passage;

a refrigerant storage tank disposed along the main refrigerant channel;

a second injection channel arranged and configured to guide a gas component of refrigerant accumulated inside the refrigerant storage tank to the compressor or the suction passage; and a control unit configured to switch between a first injection control in which refrigerant primarily flows to the first injection channel, and a second injection control in which refrigerant primarily flows to the second injection channel, the control unit switching between the first injection control and the second injection control based on a pressure of refrigerant in the main refrigerate channel between the condenser and the expansion mechanism.

2. The refrigeration apparatus according to claim 1, further comprising a second opening adjustable valve having an adjustable opening and disposed along the second injection channel, the first injection channel and the second injection channel being arranged and configured to cause refrigerant to merge with intermediate-pressure refrigerant of the compressor, and the control unit in the first injection control, causing refrigerant from primarily the first injection channel to merge with intermediate-pressure refrigerant of the compressor, and in the second injection control, causing refrigerant from primarily the second injection channel to merge with intermediate-pressure refrigerant of the compressor.

3. The refrigeration apparatus according to claim 1, wherein the control unit switches between the first injection control, the second injection control, and a non-injection control in which refrigerant does not flow in the first injection channel or the second injection channel.

* * * * *